US012025398B2

(12) United States Patent
Clemons et al.

(10) Patent No.: US 12,025,398 B2
(45) **Date of Patent: *Jul. 2, 2024**

(54) NON-LETHAL SELF-PROTECTION SYSTEM

(71) Applicant: Hero Defense Systems, LLC, Henderson, NV (US)

(72) Inventors: David S. Clemons, Henderson, NV (US); Daniel R. Danowski, Loveland, CO (US); Dawson Swan, Loveland, CO (US)

(73) Assignee: Hero Defense System, LLC, Henderson, NV (US)

( * ) Notice: Subject to any disclaimer, the term of this patent is extended or adjusted under 35 U.S.C. 154(b) by 162 days.

This patent is subject to a terminal disclaimer.

(21) Appl. No.: 17/731,888

(22) Filed: Apr. 28, 2022

(65) Prior Publication Data

US 2022/0260334 A1 Aug. 18, 2022

Related U.S. Application Data

(63) Continuation of application No. 17/065,820, filed on Oct. 8, 2020, now Pat. No. 11,320,233.

(60) Provisional application No. 62/913,608, filed on Oct. 10, 2019.

(51) Int. Cl.
*F41B 11/62* (2013.01)
*F41B 11/643* (2013.01)

(52) U.S. Cl.
CPC ..... *F41B 11/62* (2013.01); *F41B 11/643* (2013.01)

(58) Field of Classification Search
CPC ..... F41B 11/62; F41B 11/643; F41H 9/10; F42B 12/40; F42B 12/50; F42B 6/10; F42B 7/10
USPC ..... 102/502, 367, 370, 529, 444, 517; 124/57
See application file for complete search history.

(56) References Cited

U.S. PATENT DOCUMENTS

| | | | |
|---|---|---|---|
| 938,836 | A | 11/1909 | Fessenden |
| 3,109,253 | A | 11/1963 | Eig |
| 3,161,322 | A | 12/1964 | Stone |
| D226,908 | S | 5/1973 | Tadlock |
| 3,791,303 | A | 2/1974 | Sweeney et al. |
| 3,921,614 | A | 11/1975 | Fogelgren |
| 4,223,804 | A | 9/1980 | Morris et al. |
| 4,402,430 | A | 9/1983 | Fox et al. |
| D277,126 | S | 1/1985 | Numbers |
| 5,331,523 | A | 7/1994 | Delzer |
| D376,766 | S | 12/1996 | Cranford et al. |
| 5,673,819 | A | 10/1997 | Brunswig |
| D400,633 | S | 11/1998 | Chapman |
| 6,199,726 | B1 | 3/2001 | Cardwell, III et al. |

(Continued)

OTHER PUBLICATIONS

Piexon Home, "2-shot speedloader, The Piexon JPX2 Jet Protector," https://www.piexon.com/en/jpx2-home/ 7 pgs., Dec. 29, 2020.

(Continued)

*Primary Examiner* — Michael D David
(74) *Attorney, Agent, or Firm* — Thorpe North & Western, LLP

(57) ABSTRACT

A cartridge for a non-lethal self-protection system is received by a launch platform and has a barrel, a compressed gas vessel, a projectile in front of the compressed gas vessel containing an irritant, and a cannula with a sharp tip to pierce the compressed gas vessel.

20 Claims, 18 Drawing Sheets

(56) References Cited

U.S. PATENT DOCUMENTS

| | | | |
|---|---|---|---|
| D451,165 | S | 11/2001 | Fleischhauer et al. |
| 6,393,922 | B1 | 5/2002 | Winterer |
| 6,393,992 | B1 | 5/2002 | Vasel et al. |
| 6,543,365 | B1 | 4/2003 | Vasel et al. |
| 7,194,960 | B2 | 3/2007 | Vasel et al. |
| D585,520 | S | 1/2009 | Teig |
| 7,526,998 | B2 | 5/2009 | Vasel et al. |
| 7,752,974 | B2 | 7/2010 | Wenaas et al. |
| D688,769 | S | 8/2013 | Lord |
| 8,608,030 | B2 | 12/2013 | Vogt et al. |
| D706,383 | S | 6/2014 | Ben-Yair |
| 8,944,296 | B2 | 2/2015 | Vogt et al. |
| D731,612 | S | 6/2015 | Ying |
| 9,386,438 | B2 | 7/2016 | Hymowitz |
| D805,157 | S | 12/2017 | Pennington |
| D806,824 | S | 1/2018 | Fan |
| D820,940 | S | 6/2018 | Norris et al. |
| 10,295,302 | B2 | 5/2019 | Lort |
| D879,236 | S | 3/2020 | Arshad |
| D889,591 | S | 7/2020 | Fan |
| 10,782,109 | B1 | 9/2020 | Pedicini et al. |
| 2003/0047105 | A1 | 3/2003 | Vasel et al. |
| 2004/0020946 | A1 | 2/2004 | Fleischhauer et al. |
| 2004/0046669 | A1 | 3/2004 | Chiapperini |
| 2004/0129730 | A1 | 7/2004 | Parsons |
| 2005/0016412 | A1 | 1/2005 | Vasel et al. |
| 2005/0188886 | A1 | 9/2005 | Vasel et al. |
| 2006/0011090 | A1 | 1/2006 | Vasel et al. |
| 2006/0027223 | A1 | 2/2006 | Vasel et al. |
| 2007/0039226 | A1 | 2/2007 | Stokes |
| 2007/0167241 | A1 | 7/2007 | Stethem et al. |
| 2007/0238532 | A1 | 10/2007 | Stethem |
| 2007/0245919 | A1 | 10/2007 | Vasel et al. |
| 2008/0017179 | A1 | 1/2008 | Vasel et al. |
| 2008/0158859 | A1 | 7/2008 | McMeekin et al. |
| 2008/0245818 | A1 | 10/2008 | Strickland |
| 2009/0013893 | A1 | 1/2009 | Vasel et al. |
| 2009/0071459 | A1 | 3/2009 | Wenaas et al. |
| 2009/0266262 | A1 | 10/2009 | Vasel et al. |
| 2010/0275895 | A1 | 11/2010 | Wenaas et al. |
| 2014/0048561 | A1 | 2/2014 | Mangold |
| 2019/0249698 | A1 | 8/2019 | Chen |
| 2019/0301728 | A1 | 10/2019 | Harvey |
| 2020/0400304 | A1 | 12/2020 | Harvey |
| 2021/0108879 | A1* | 4/2021 | Clemons ..... F41H 9/10 |

OTHER PUBLICATIONS

Byrna, "The Byrna HD (Home Defense)," https://byrna.com/collections/byrna-hd , 7 pgs., Dec. 29, 2020.

Sabre, "Aim and Fire Pepper Gel with Trigger and Grip Deployment System," https://www.sabrered.com/pepper-spray/aim-and-fire-pepper-gel-trigger-and-grip-deployment-system 3 pgs., Dec. 29, 2020.

* cited by examiner

NON-LETHAL SELF-PROTECTION SYSTEM

PRIORITY CLAIM

This is a continuation of U.S. patent application Ser. No. 17/065,820, filed Oct. 8, 2020, now U.S. Pat. No. 11,320, 233, issued May 3, 2022, which claims priority to U.S. Provisional Patent Application Ser. No. 62/913,608. filed Oct. 10, 2019, which are hereby incorporated herein by reference.

BACKGROUND

Personal protection is an ongoing concern for many people. Personal protection often involves carrying a firearm, such a as a pistol. Some jurisdictions restrict and limit an individual's ability to carry a firearm. Some individuals have personal issues with firearms, such as the lethal nature of firearms, risk of accidental discharge, risk of accidental accessibility by a child, etc. Other non-lethal devices have been developed, including pepper spray, mace spray, electroshock weapons such as stun guns, etc. The development of non-lethal self-protection solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
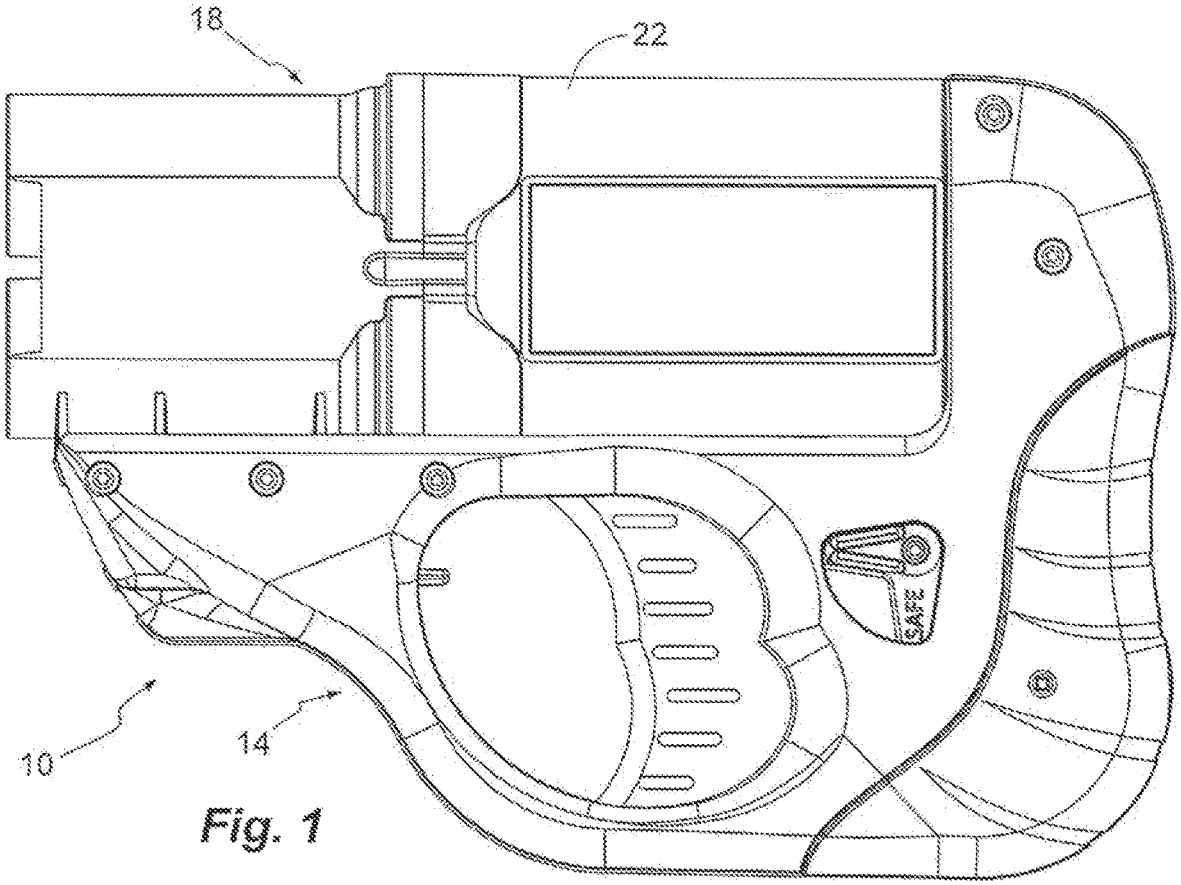
FIG. 1 is a side view of a non-lethal self-defense system with a ball cartridge in a launch platform in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of"

or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order.

It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term 'about' is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

The term "non-lethal" is used herein to refer to a result that is unlikely and/or incapable in causing death when used with a human or animal greater than ten pounds. The term "self-protection" is used herein to refer to a result that is likely and capable of impeding human or animal aggression. Thus, the non-lethal self-protection system and weapon described herein is intended to stop or resist aggression by a human or animal without causing death.

The term "irritant" is used herein to refer to a material that causes a severe reaction in a human or animal sufficient to impede aggression, but without being lethal. For example, an irritant can comprise pharmaceutical-grade organic and/or synthetic pepper compounds of oleoresin capsicum. As another example, the irritant can comprise active pelargonic acid vanillylamide (PAVA). The irritant can be or can be carried in various forms, including powder and gel.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A non-lethal self-defense system is provided to offer an individual personal protection against aggression or threat while also offering peace-of-mind with respect to risks of accidental access and discharge by a child, personal moral issues associated with taking a life, legal restrictions associated with carrying a firearm, etc. The system is considered to be the smallest and most powerful self-defense product in its class. The system offers a compact and easy to conceal non-lethal tool anyone can use. The system has dual shot, dual finger trigger design that fits comfortably in the palm of the hand, with a safety switch on both sides for operating with either hand. The system can also have a light emitting diode (LED) stun light and a Class 2 laser for aiming The system has a launcher and a launch platform that receives interchangeable cartridges with compressed gas, such as nitrogen, to launch projectiles, such as frangible ball, gel and powder projectiles, under high pressure and at high speeds. The projectiles can contain an irritant, such as specially formulated pharmaceutical-grade formula of organic and synthetic pepper compounds. For example, the irritant can be an active pelargonic acid vanillylamide (PAVA) or an oleoresin capsicum agent. The system can launch projectiles up to 250 feet per second (FPS) from 20 feet away to protect against attackers and animals at close encounters of up to 4 to 15 feet.

The high-speed kinetic energy and impact of the projectile has stopping power as the frangible ball projectile can hit the target at approximately 200 feet per second and with approximately 15 Joules of energy. On impact, the frangible ball breaks into smaller pieces and releases the active PAVA powder agent inside. The frangible ball creates an ultra-fine cloud of PAVA dust 3-6 feet in size that surrounds the target, causing an immediate reaction. The pepper ingredient causes immediate burning irritation of the eyes, nose, mouth and skin. The large area of effect makes the frangible ball a good choice for wide open spaces and outdoor areas without crowds. Each frangible ball can be about 3 g and can contains about 10% PAVA (active ingredient). The cartridge can hold two projectiles.

The gel projectile can be delivered with the same speed as the frangible ball, but in a heavier liquid gel format, instantly covering the exposed skin, eyes, nose, and mouth of an attacker. The gel projectile can be an effective means of personal protection because the liquid gel instantly covers all exposed areas of the attacker or animal. The gel cartridge can release a focused spray of gel, ensnaring a target with burning irritant that sticks. Excess gel can fall to the ground rather than hanging in the air. The gel can be a good choice for indoor or crowded areas. The gel can be powered by compressed gas in a single, direct impact, high pressure cavity. Firing at over 1000 PSI, the gel can travel up to 200 FPS from up to 15 feet away. The gel cartridge can contain two payloads. Each payload can have 8 ml of gel and can have 10% PAVA.

In either, ball, gel or powder formats, the active ingredient or active agent causes intense pain, confusion and greatly impairs the vision of an attacker. The disposable, double-shot cartridges provide for ease and speed of reloading.

The system can be carried on a person or stored in close proximity to the individual such as concealed within a pocket, a backpack, or safely stored at home or within an automobile, for example. The system has a wide potential of user/audience groups regarding age, gender, education, economic level, geographic location and interested in having immediate access to a powerful, less-lethal personal protection solution that provides more safety for the user and is reliable in use to demotivate most attackers or animals.

For example, the system can be utilized by an active outdoor enthusiast who likes to walk, jog, run, bike or participate in other outdoor activities that might be away from the populated areas and or protection of crowds or family and friends. As another example, the system can be utilized by someone who finds themselves indoors in an unoccupied or sparsely occupied building, stairway, parking garage, and may be alone and feeling vulnerable. The average person does not carry a personal protection device due to the physical size and weight of the device. Other than small ineffective peppery spray canisters, there are few options that meet this groups' lifestyle and real safety requirements.

As another example, an individual may have a need of a self-defense strategy, but are uncomfortable with carrying a lethal weapon, such as a handgun. The present system provides a similar feel as a handgun, in the way the unit is held, but the deployment of the unit will only cause temporary disablement to the assailant and is thus a less-lethal solution. The present system may not come under concealed carry laws that would be in place for a concealed handgun or weapon.

As another example, a professional, such as a security guard, that is not allowed to carry a lethal weapon may still need personal protection on the job. The present system presents a compact, lightweight device that can easily be placed in hand, in a pocket or purse with easy access. When an individual begins to feel uneasy of their immediate surroundings, they can easily access the device and be ready to deploy personal protection.

In one aspect, the cartridges provide a power system to develop sufficient static to dynamic energy to instantaneously propel the projectile in a small space to allow the system or weapon to be easily carried, and without a timed build-up of pressure behind a projectile as it travels down an elongated barrel as is common in traditional firearms or even traditional paintball guns.

The cartridge provides sufficient back pressure with a seal that holds the projectile in place without releasing the projectile until there is sufficient pressure behind the projectile to project it at speed.

In another aspect, the cartridge can provide a cartridge precursor that can be fitted with different types of projectiles. For example, the same cartridge precursor can be produced and fitted with at least two different projectiles in one aspect, and at least three different projectiles in another aspect, and at least four different projectiles in another aspect. The projectiles can include a frangible ball with a powdered irritant, a gel containing irritant in a syringe carried by the cartridge, a powdered irritant in a shell carried by the cartridge, and a frangible ball containing an inert powder, or a gel or powder that is inert (defining a practice blank or round). Thus, the same cartridge precursor can be used for different mediums.

Referring to FIGS. 1-10 and 25, a non-lethal self-protection system 10 and weapon is shown for launching and projecting a non-lethal projectile against a human or animal aggressor and threat. The system 10 comprises a launch platform 14 replaceably carrying at least one replaceable cartridge 18. In one aspect, a non-lethal self-protection kit can be provided with at least two cartridges with different projectiles, and a third practice cartridge with an inert projectile. The cartridges can be color coded to identify the type of projectile contained therein. In one aspect, the cartridges 18 can be double shot cartridges configured to carry a pair of projectiles which are separately projected to provide for two shots. Thus, the cartridges 18 can carry a pair of separate components which will be described singularly herein, unless otherwise noted, with the understanding that such description applies to both components.

Referring to FIGS. 10-21, a cartridge 22 is shown carrying a frangible ball 26 containing irritant, defining a ball cartridge. A gel or powder cartridge will be described below. The cartridge 22 comprises a housing 30 with a barrel 34. In one aspect, the barrel 34 can be a double barrel comprising a pair of aligned barrels. The barrel 34 can be short relative to traditional firearms and can have a barrel length less than 7 cm in one aspect, and less than 6 cm in another aspect. The cartridge 22 and the housing 30 can further comprise a casing 38 coupled to the barrel 34. The casing 38 can be a rear casing forming a rear of the housing 30 while the barrel 34 can form a front of the housing 30. An attachment, such as a dovetail attachment 42, can be carried by the housing 30 to releasably engage with the launch platform 14. The dovetail attachment 42 can comprise a projection extending downward and/or laterally outward, and can form a bottom-most portion of the housing 30. The dovetail attachment 42 can also comprise separate projections arrayed along a length of the housing 30 and extending from both the barrel 34 and the casing 38. The barrel 34 and the casing 38 can be connected by a connection therebetween. The connection can comprise a pair of arms 46 (FIG. 18) extending from one of the casing 38 and the barrel 34, such as the barrel 34, to the other of the casing 38 and the barrel 34, such as the casing 38. The pair of arms 46 can be flexible and resilient, and can carry distal hooks, to engage edges in the casing 38, and to form a snap fit that can be further positively attached by a fastener therethrough. The barrel 34 and the casing 38 can be formed of plastic and can be formed by injection molding.

Figure 2:
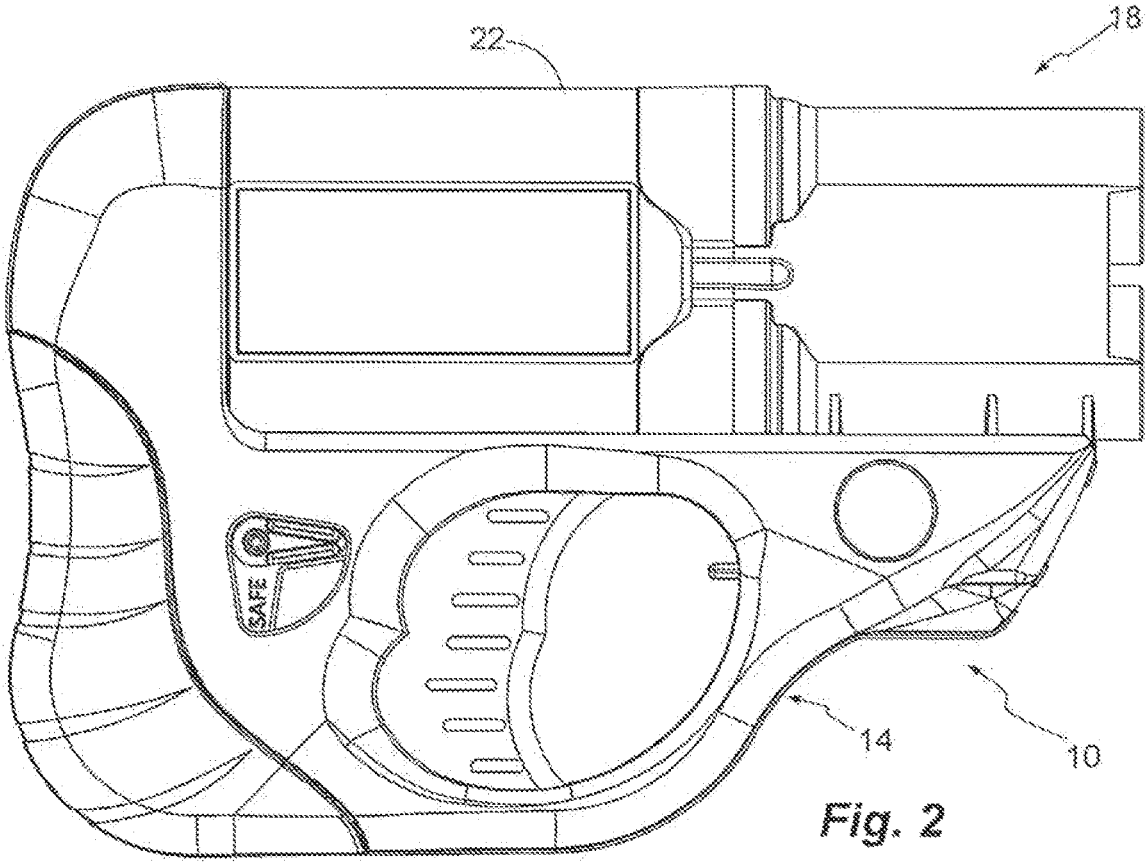
FIG. 2 is an opposite side view of the system of FIG. 1.
Figure 3:
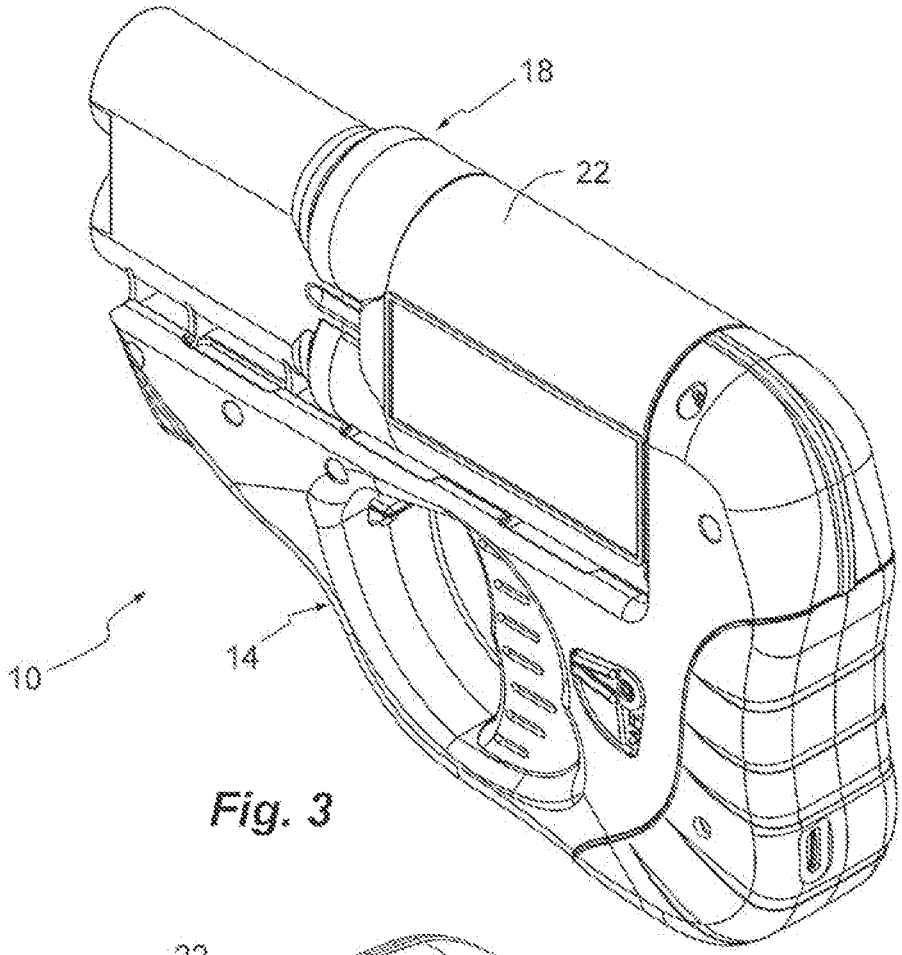
FIG. 3 is a rear perspective view of the system of FIG. 1.
Figure 4:
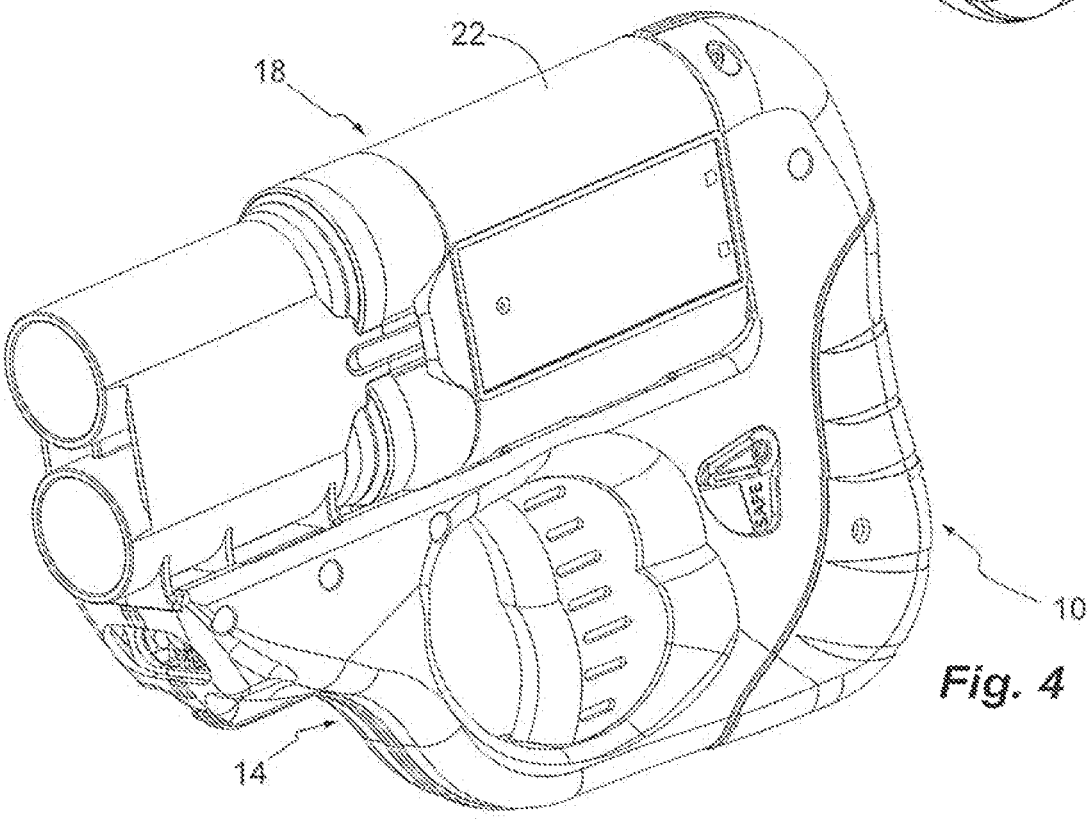
FIG. 4 is a front perspective view of the system of FIG. 1.
Figure 5:
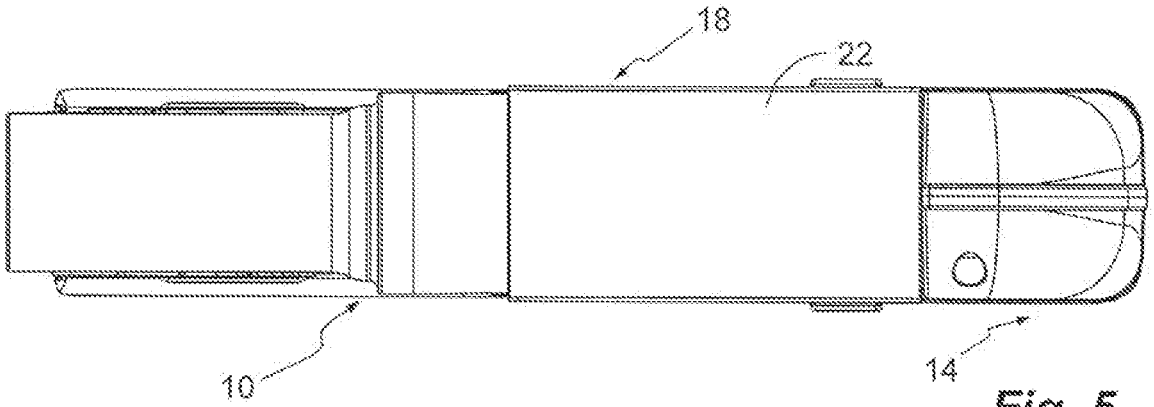
FIG. 5 is a top view of the system of FIG. 1.
Figure 6:
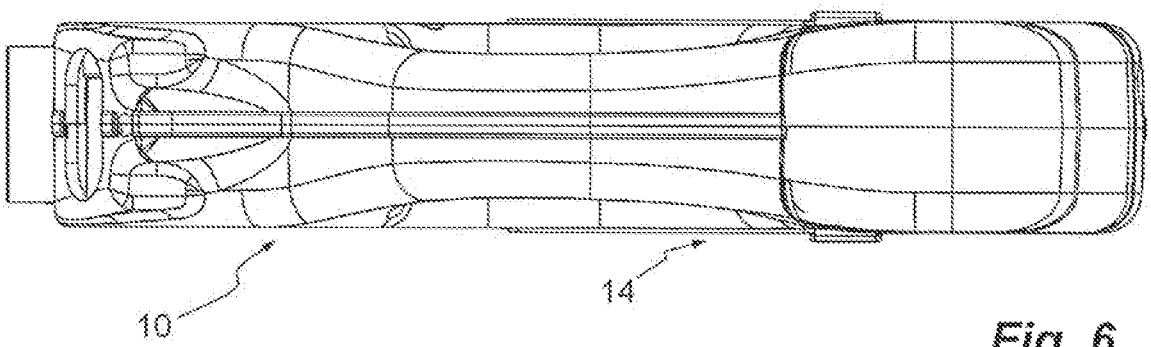
FIG. 6 is a bottom view of the system of FIG. 1.
Figure 7:
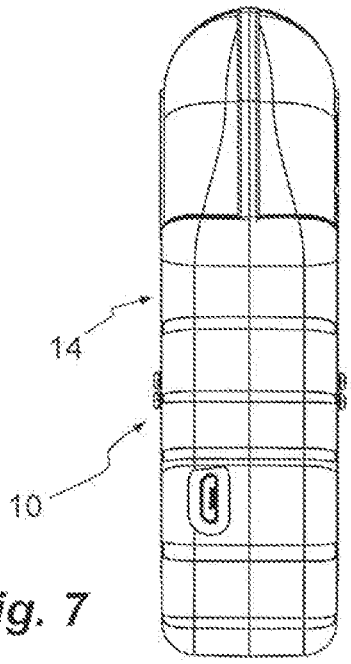
FIG. 7 is a rear view of the system of FIG. 1.
Figure 8:
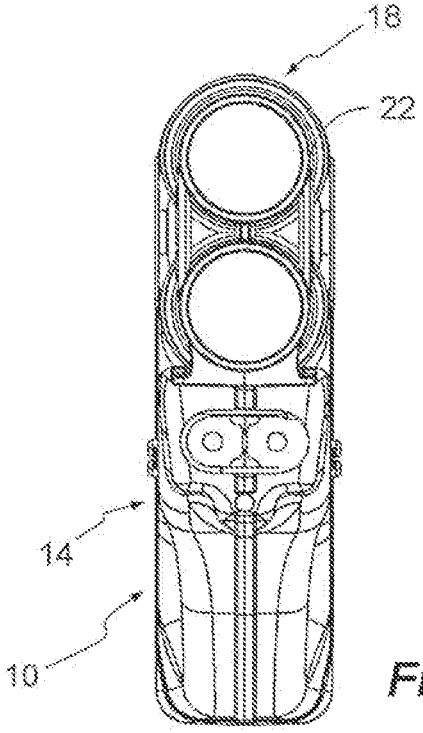
FIG. 8 is a front view of the system of FIG. 1.
Figure 9:
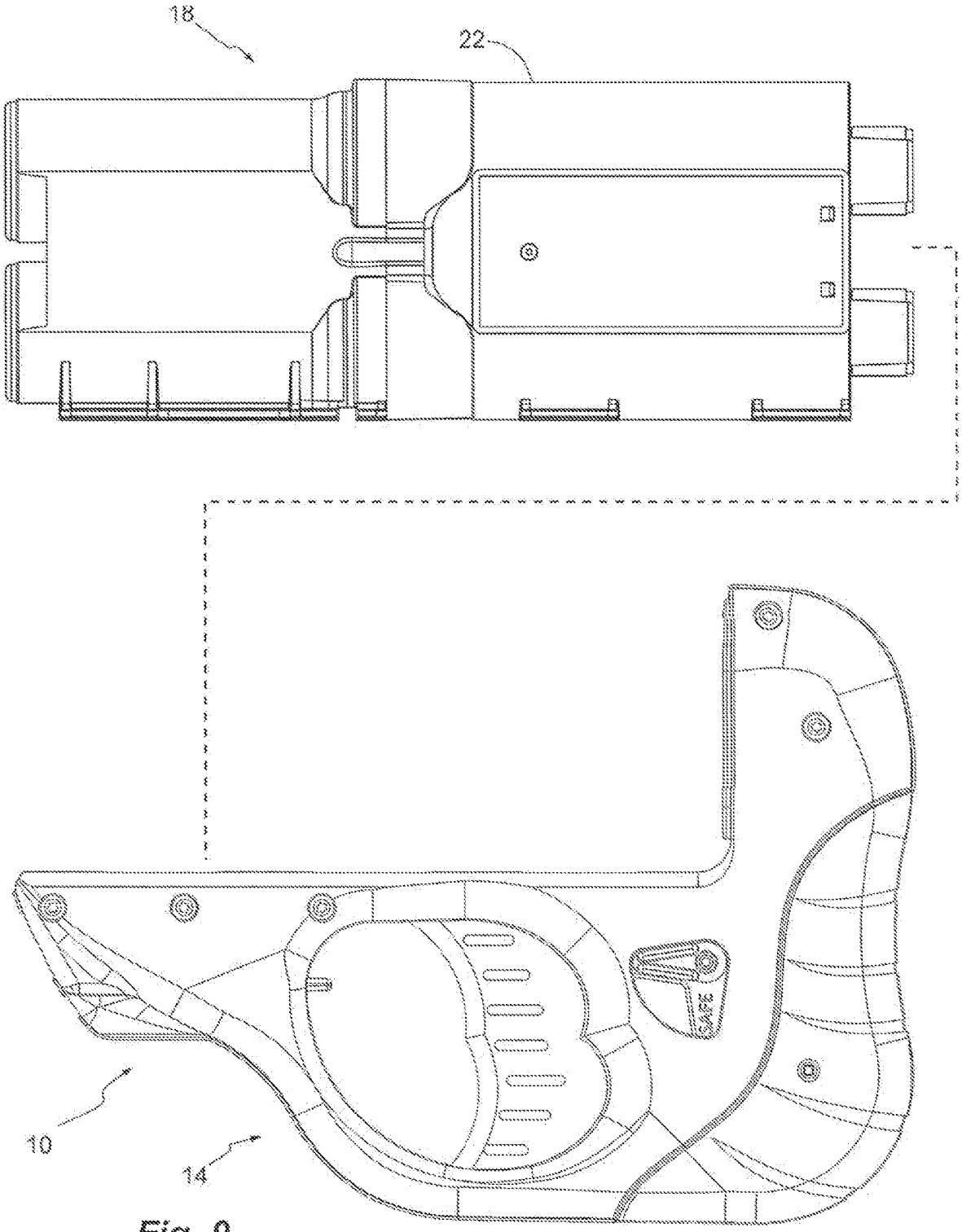
FIG. 9 is an exploded side view of the system of FIG. 1 showing the cartridge removed from the launch platform.
Figure 10:
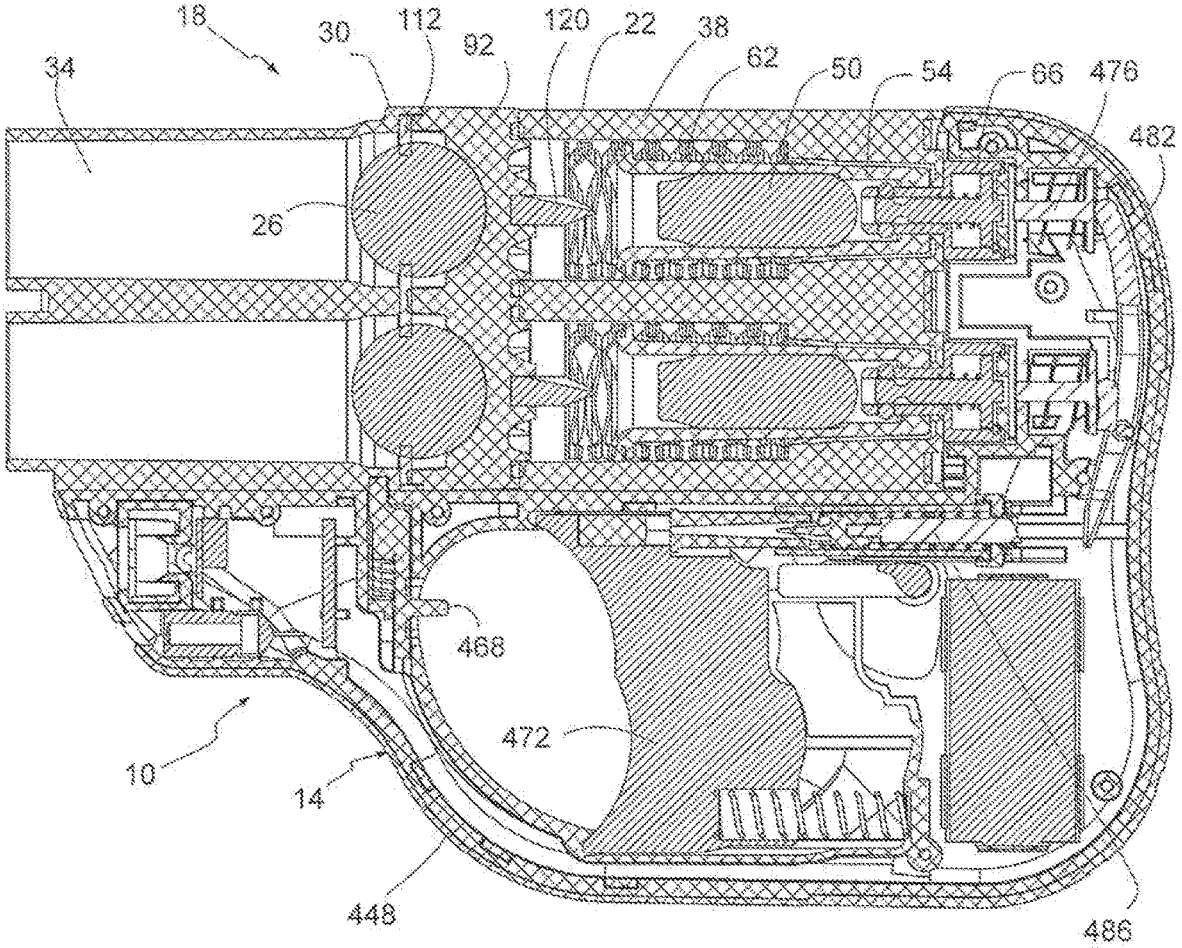
FIG. 10 is a cross-sectional side view of the system of FIG. 1.
Figure 11:
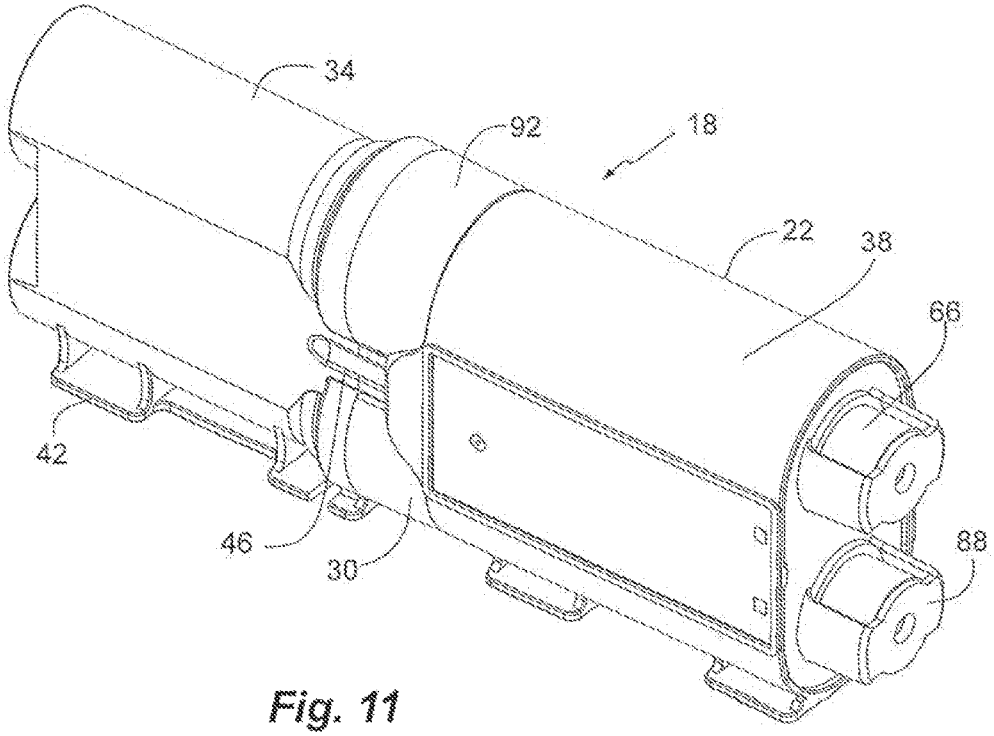
FIG. 11 is a rear perspective view of the cartridge of FIG. 1.
Figure 12:
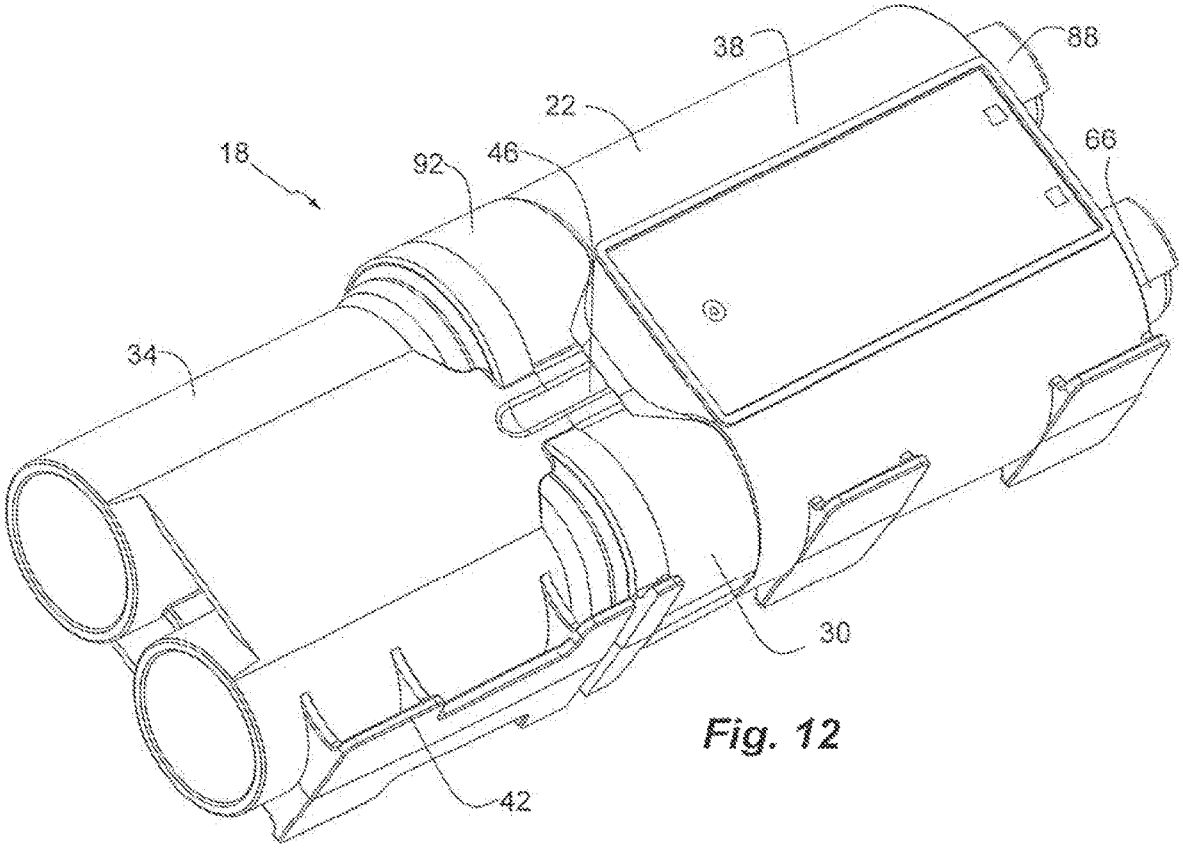
FIG. 12 is a front perspective view of the cartridge of FIG. 1.
Figure 13:
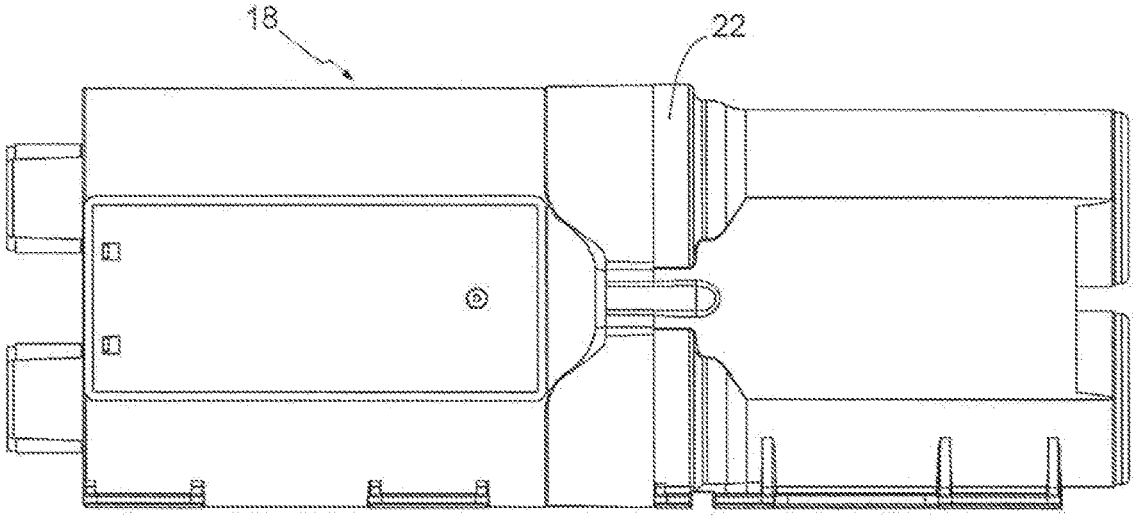
FIG. 13 is an opposite side view of the cartridge of FIG. 1.
Figure 14:
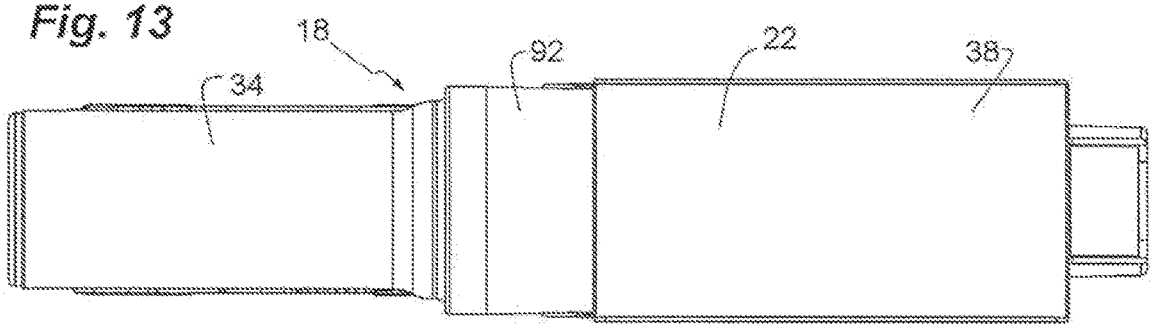
FIG. 14 is a top view of the cartridge of FIG. 1.
Figure 15:
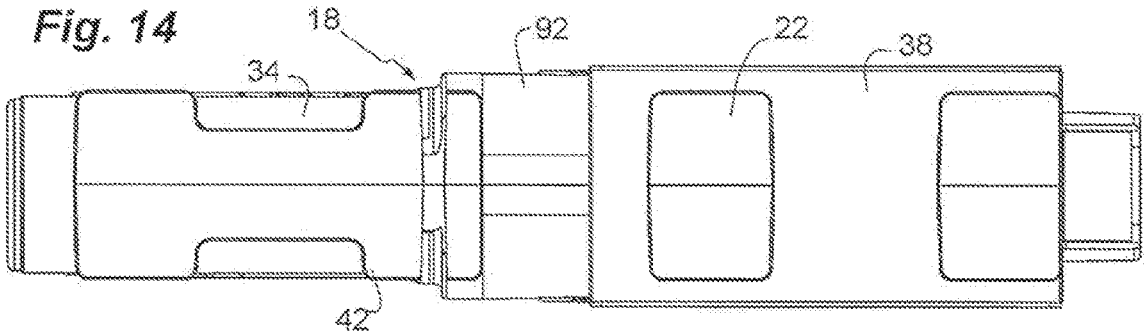
FIG. 15 is a bottom view of the cartridge of FIG. 1.
Figure 16:
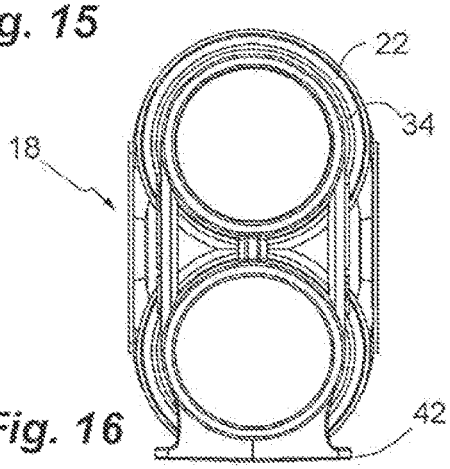
FIG. 16 is a front view of the cartridge of FIG. 1.
Figure 17:
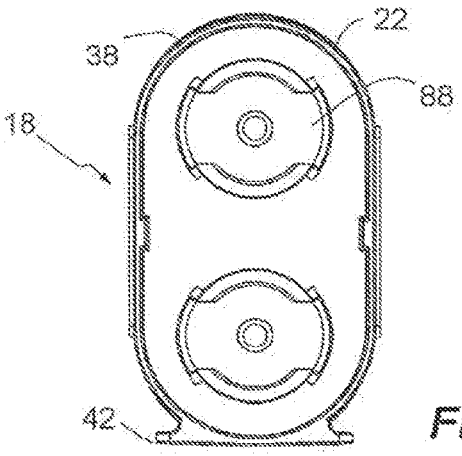
FIG. 17 is a rear view of the cartridge of FIG. 1.
Figure 20:
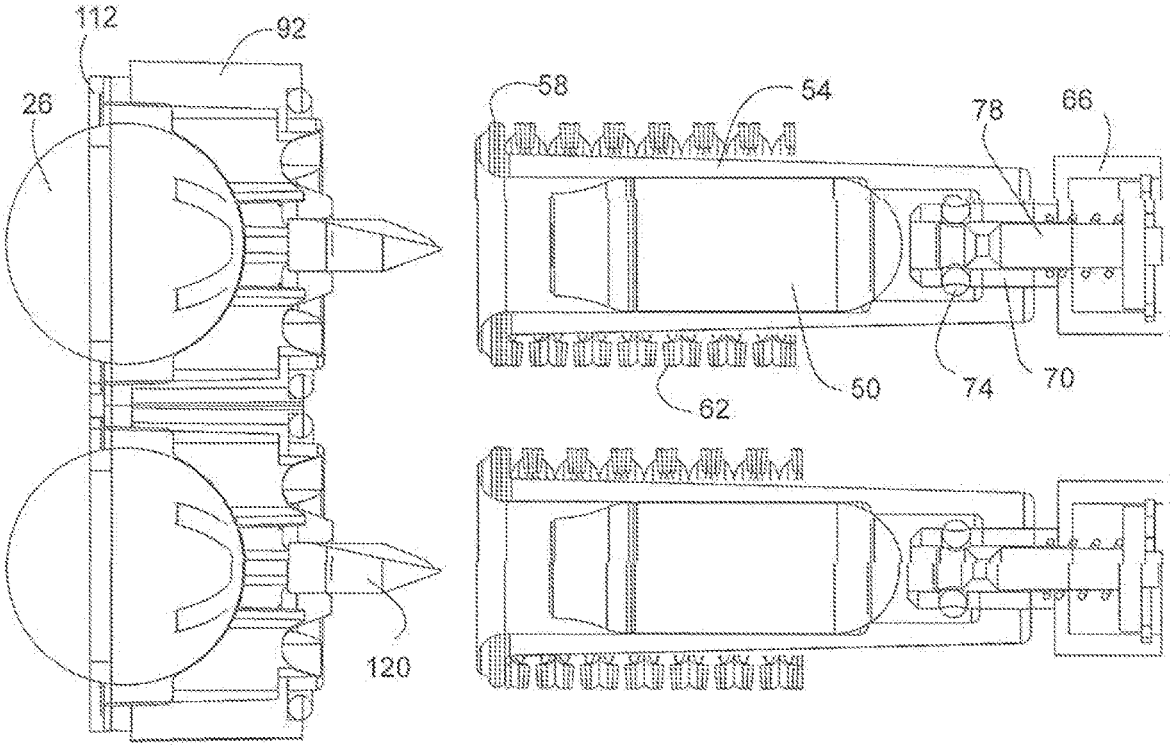
FIG. 20 is a cross-sectional side schematic view of the cartridge of FIG. 1 showing sleeves and compressed gas vessels in a retained position.
Figure 21:
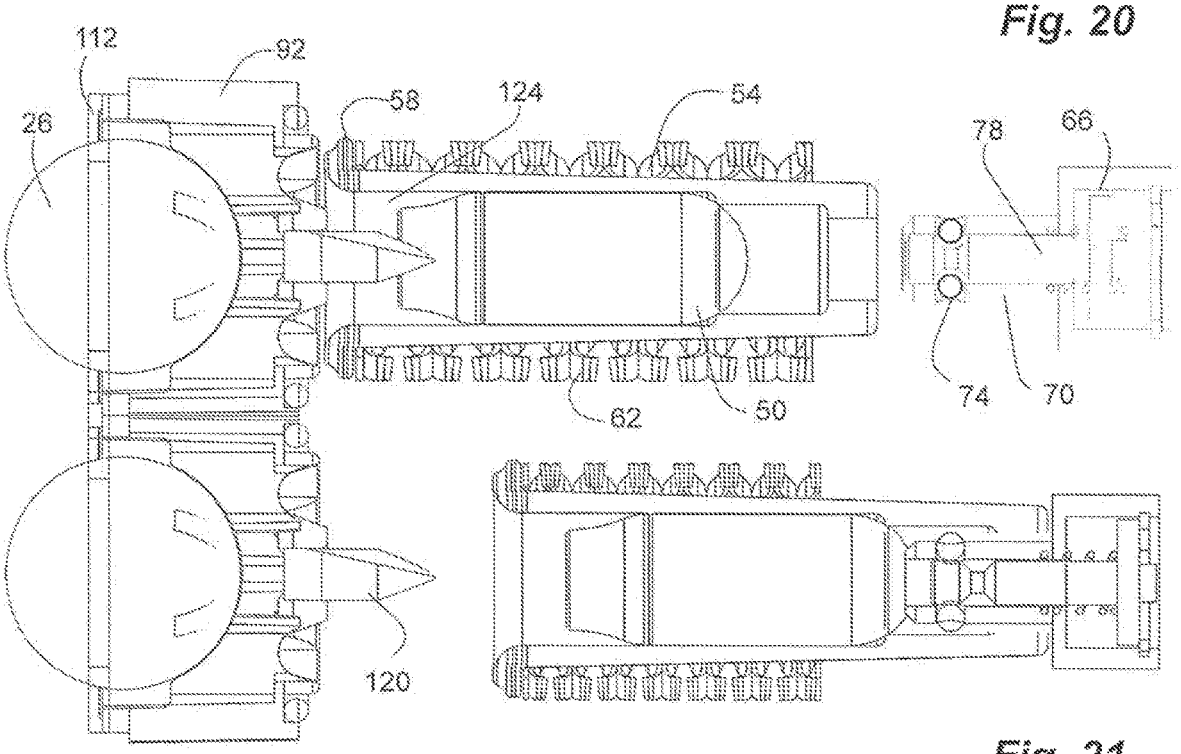
FIG. 21 is a cross-sectional side schematic view of the cartridge of FIG. 1 showing a sleeve and a compressed gas vessel in a released position.

The projectiles and the frangible ball 26 can be projected and expelled by gas pressure from a compressed gas vessel 50 containing compressed gas and carried by the housing 30 and positioned in the casing 38. The cartridge 22 can comprise a pair of compressed gas vessels 50. In one aspect, the vessel 50 can be a cylinder. In another aspect, the compressed gas can be carbon dioxide ($CO_2$), and the $CO_2$ can be compressed to about 1795 psi. In another aspect, the compressed gas can be nitrogen, and the nitrogen can be compressed to about 2750 psi. The compressed gas vessel 50 can be retained from movement in the casing 38, but selectively movably during use. The vessel 50 can be contained in a sleeve 54 carried by the housing 30 and positioned in the casing 38. Similarly, the sleeve 54 can be retained from movement in the casing 38, but selectively movably during use. The sleeve 54 and the vessel 50 can have two positions, comprising: 1) a retained position, as shown in FIG. 20, and 2) a released position, as shown in FIG. 21 by the top sleeve and the top vessel. In the retained position, the sleeve 54 and the vessel 50 are farther from the barrel 34. In the released position, the sleeve 54 and the vessel 50 are closer to the barrel 34. In addition, in the released position, the vessel 50 is forced against a cannula to pierce the vessel 50 and release the compressed gas, as discussed below.

The sleeve 54 can have a forward opening with a flange 58. The flange 58 can circumscribe the forward opening and can extend radially outwardly. The sleeve 54 can further have a rear open end and aperture. In one aspect, the vessel 50 can seal the sleeve 54, such as with an outer diameter of the vessel 50 substantially matching an inner diameter of the sleeve 54, so that the rear open end and aperture are sealed from the forward open end. In one aspect, the vessel 50 can be press-fit in the sleeve 54. In another aspect, the vessel 50 can be adhered in the sleeve 54. The sleeve 54 can be formed of metal, such as aluminum, and can be shaped by forging. The vessel 50 can be formed of metal and can have an opening closed by a cap that can be pierced.

A spring 62 is carried by the housing 30 and positioned in the casing 38 to bias the sleeve 54 and the compressed gas vessel 50 towards the released position. The spring 62 can be compressed between the flange 58 of the sleeve 54 and a step inside the casing 38. In one aspect, the spring 62 can be a wave spring. In one aspect, the spring 62 can exert a force greater than 10 lbs.

A retainer 66 is carried by the housing 30 and the casing 38. The retainer 66 selectively retains the sleeve 54 and the compressed gas vessel 50 in the retained position. The retainer 66 can be held by a rear wall of the housing 30 and the casing 38, and can extend into the rear open end and aperture of the sleeve 54. In one aspect, the retainer 66 can be or can comprise a ball-lock engaging the open proximal end of the sleeve 54. The retainer 66 and the ball-lock can comprise a tube 70 carried by the housing 30 and the casing 38 and extending into the open proximal end of the sleeve 54. The tube 70 can have an enlargement outside of the tube 70 and the casing 38 with a cavity therein.

Figure 18:
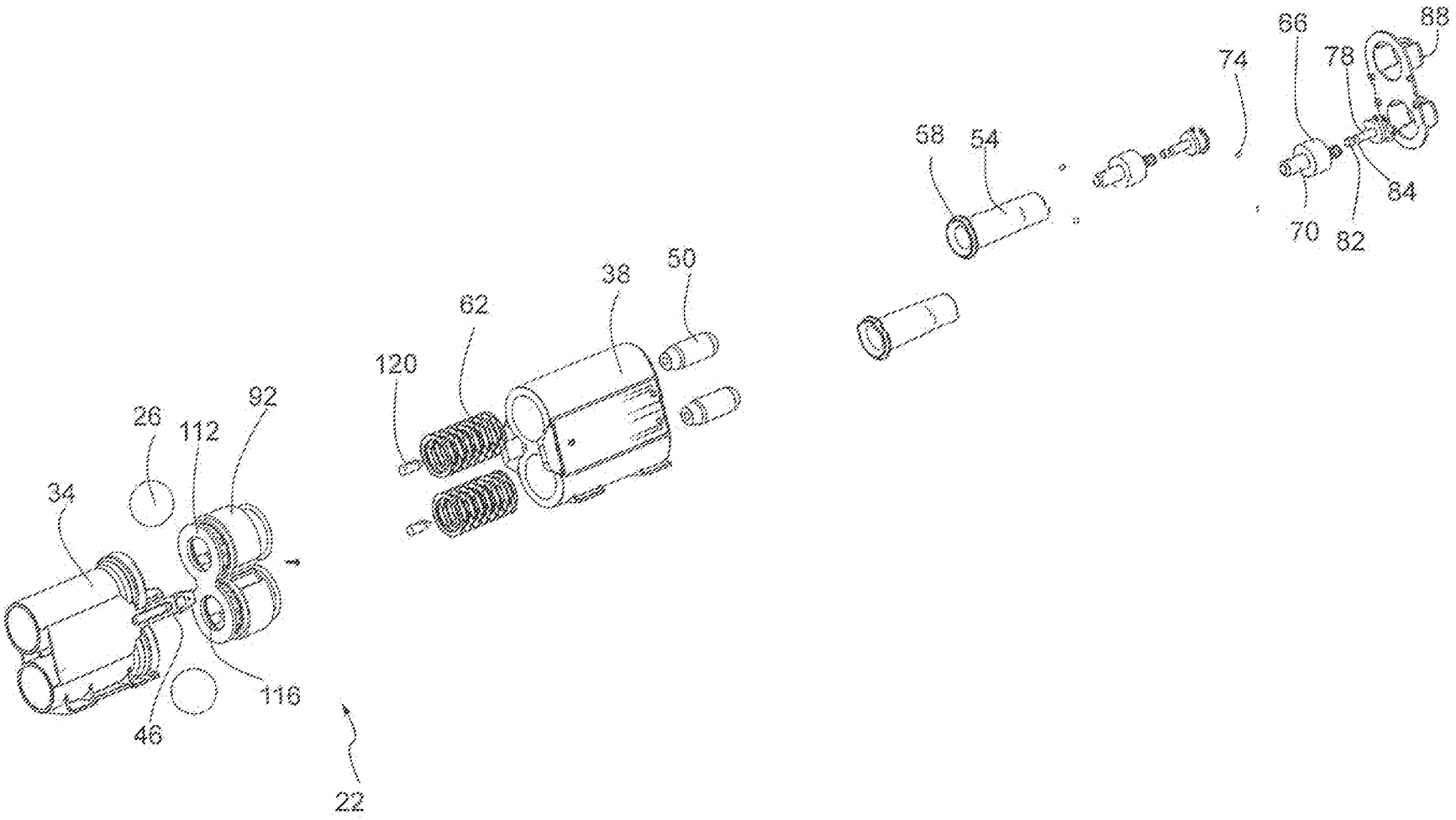
FIG. 18 is an exploded view of the cartridge of FIG. 1.
Figure 24:
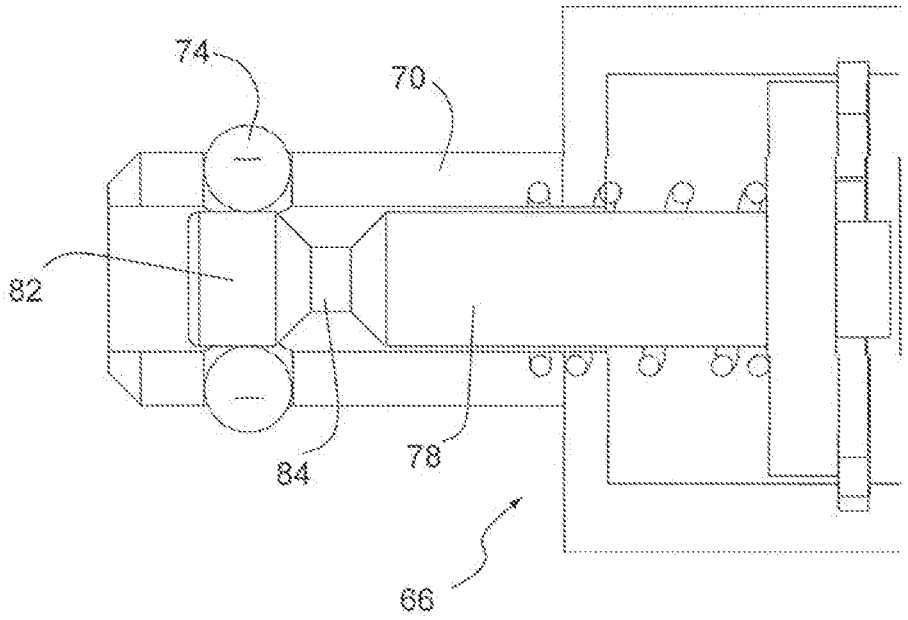
FIG. 24 is a cross-sectional side perspective view of a retainer of the cartridge of FIG. 1.
Figure 25:
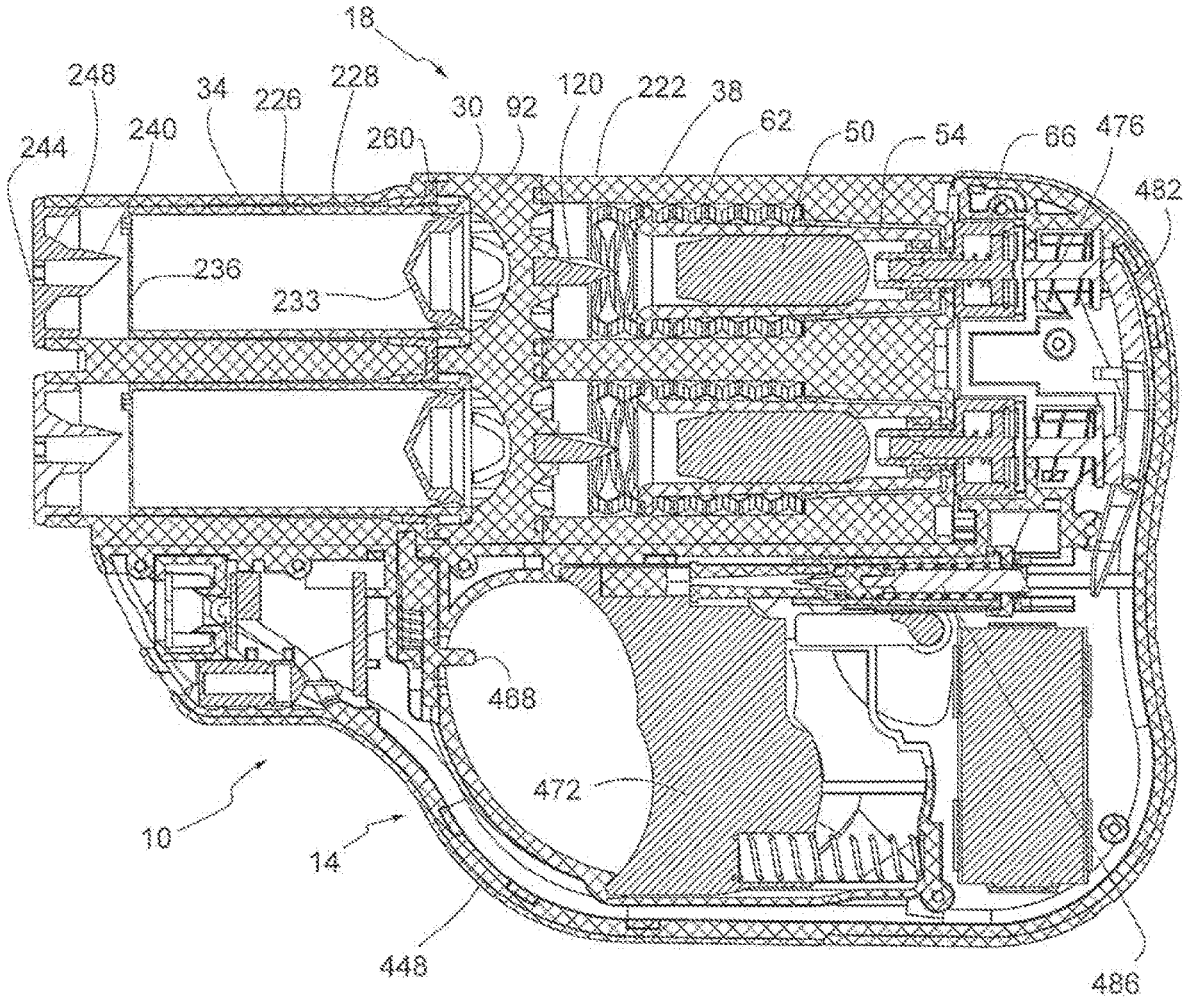
FIG. 25 is a cross-section side view of the non-lethal self-defense system with a gel or powder cartridge in the launch platform in accordance with an embodiment of the invention.
Figure 26:
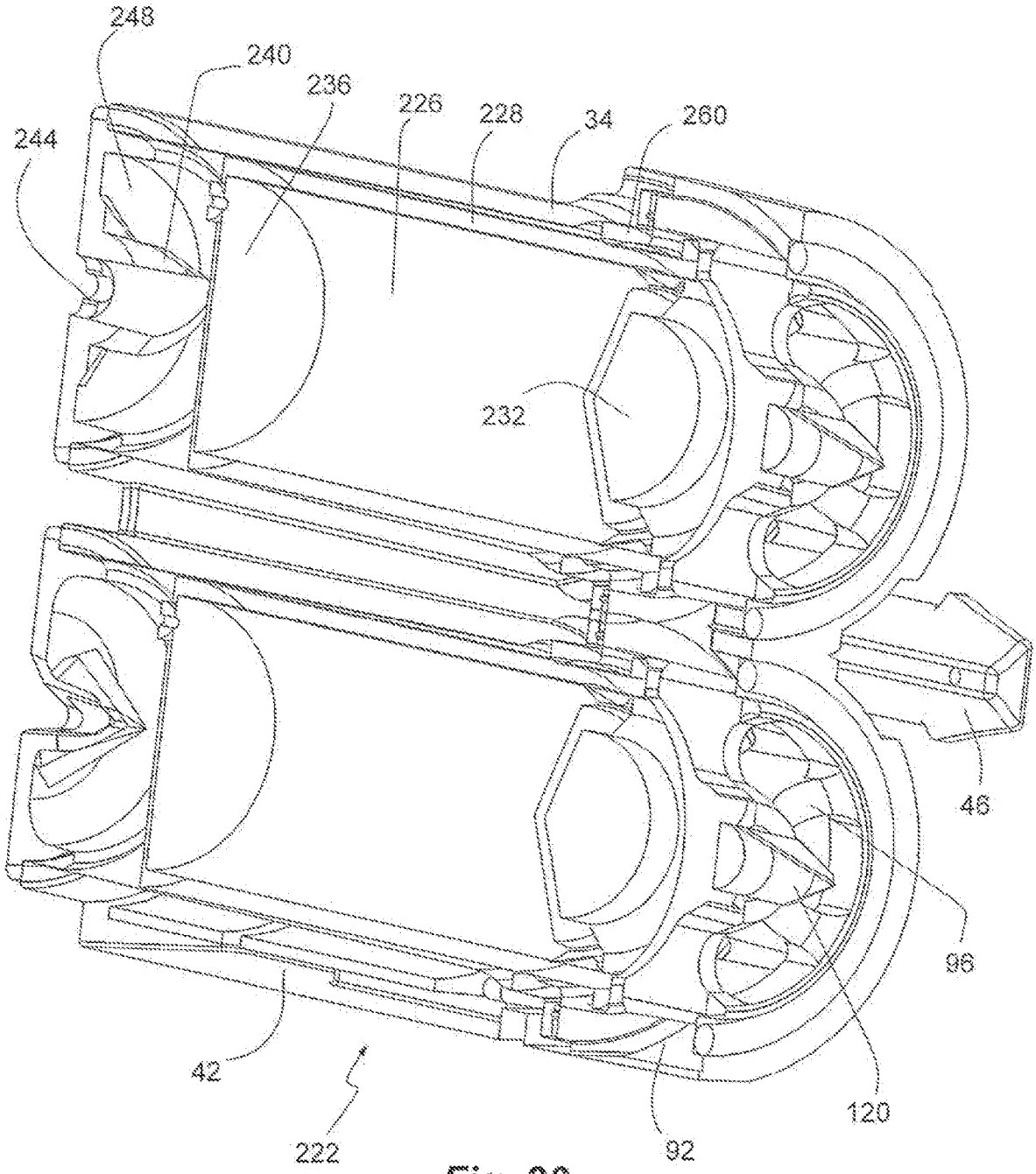
FIG. 26 is a cross-sectional side perspective view of a portion of the cartridge of FIG. 25.
Figure 27:
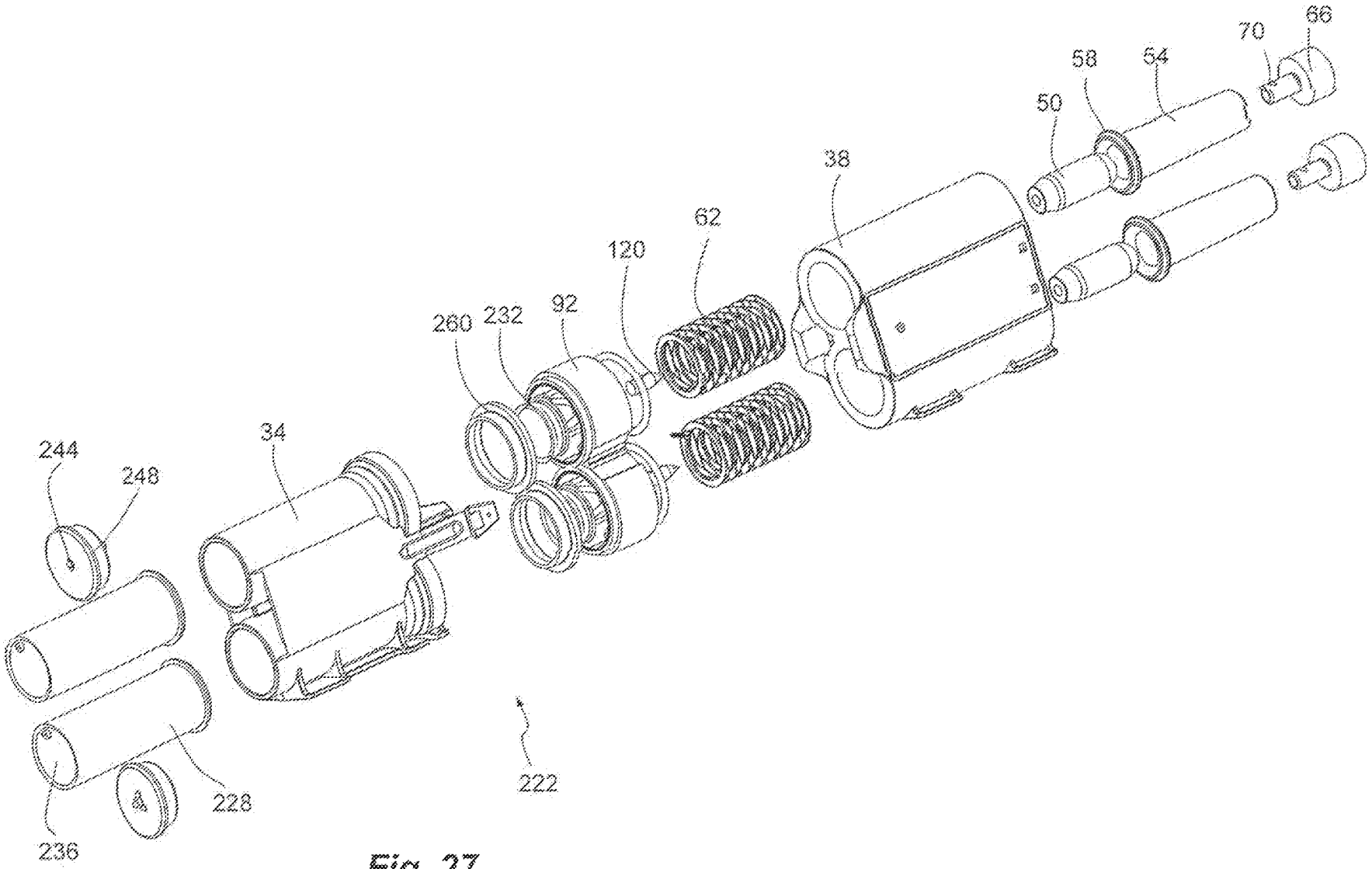
FIG. 27 is an exploded view of the cartridge of FIG. 25.
Figure 28:
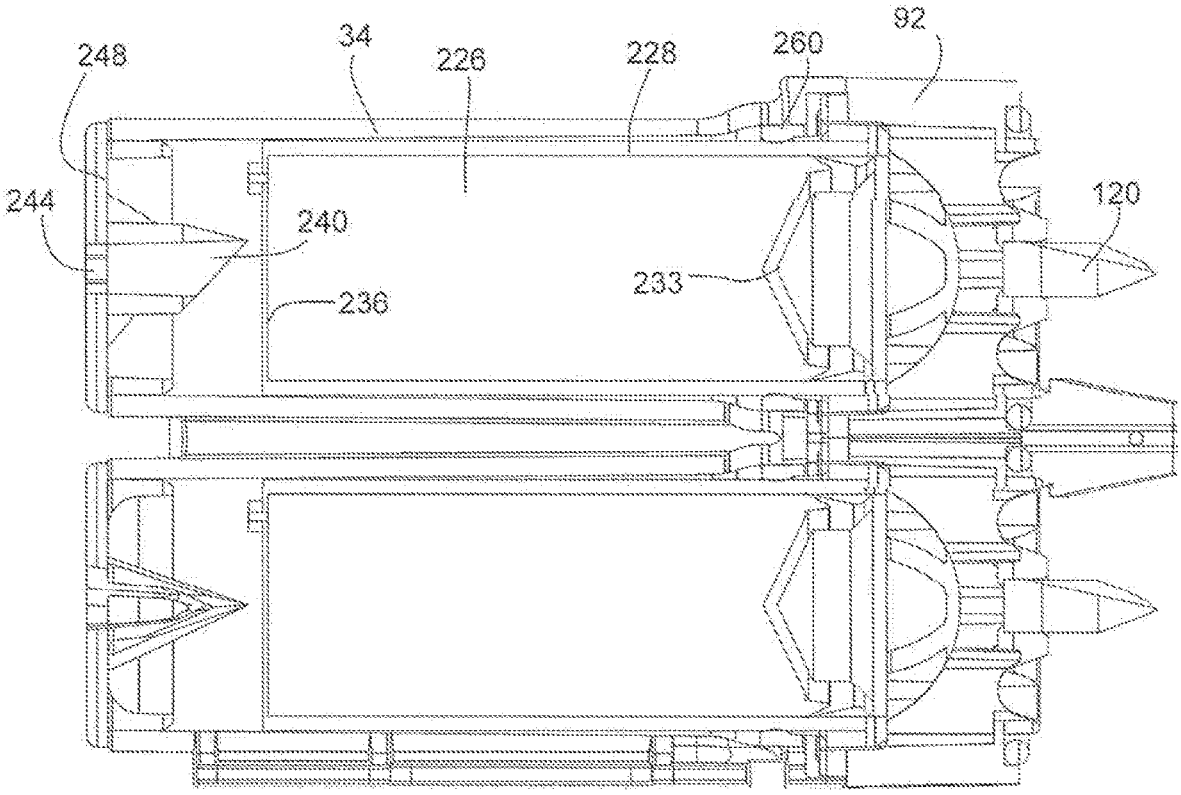
FIG. 28 is a cross-sectional side schematic view of a portion of the cartridge of FIG. 25 showing a container in a retained position.
Figure 29:
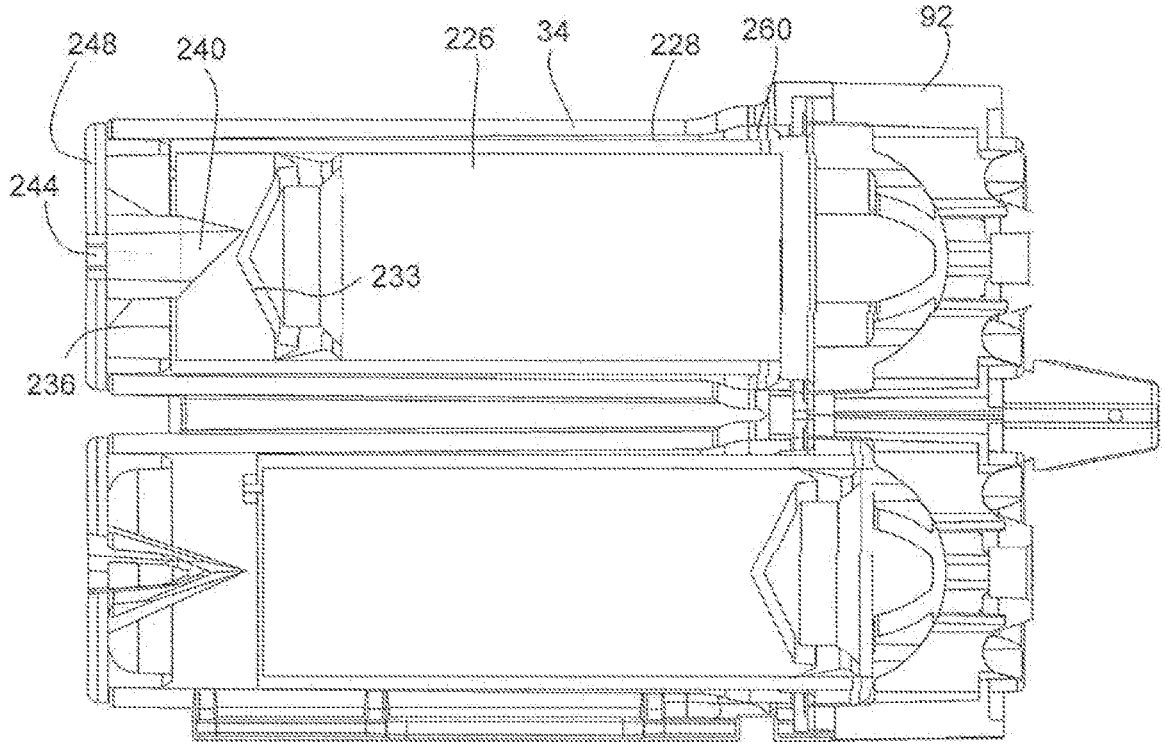
FIG. 29 is a cross-sectional side schematic view of a portion of the cartridge of FIG. 25 showing the container in a released position.
Figure 30:
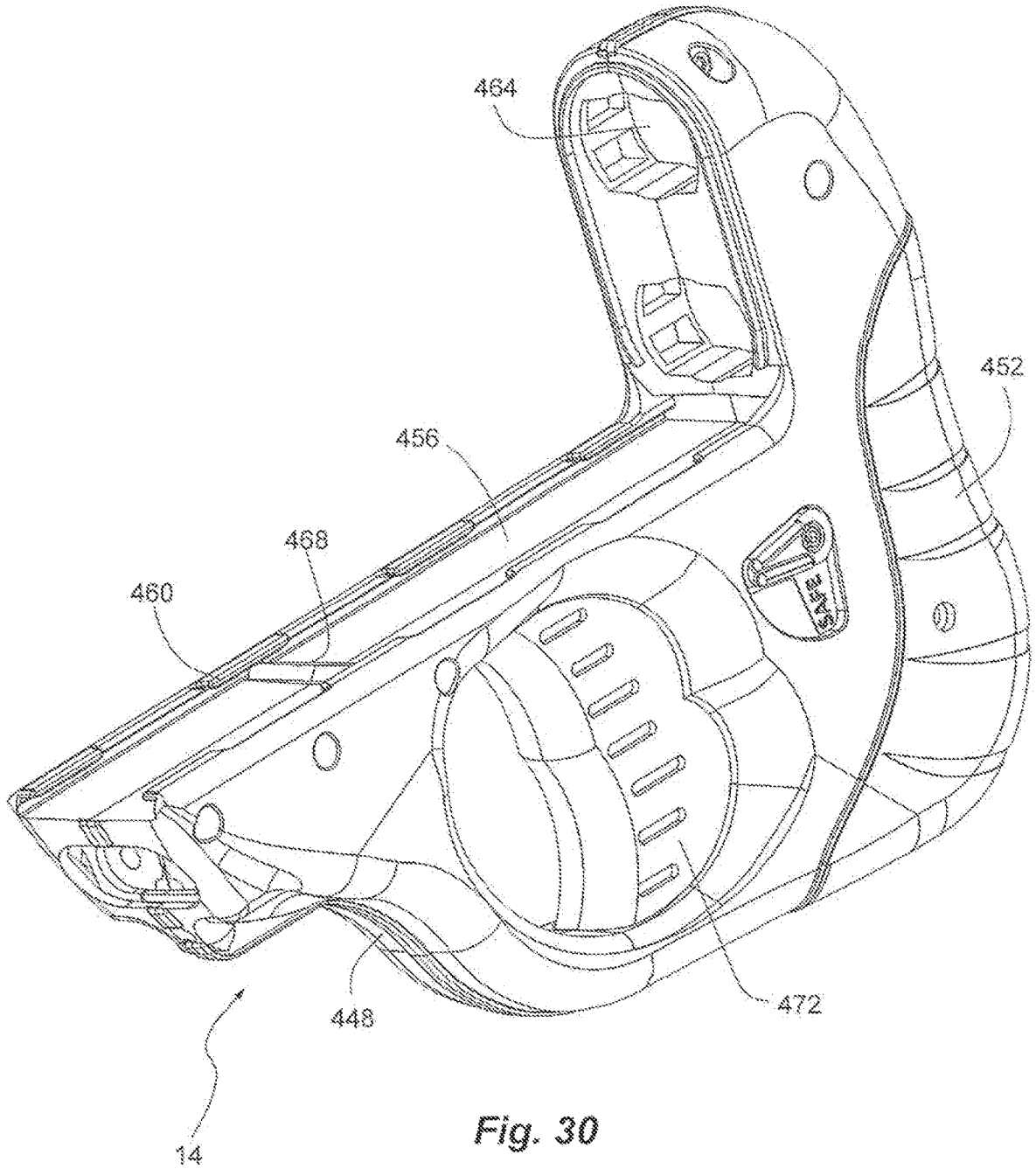
FIG. 30 is a perspective view of the launch platform of FIGS. 1 and 17, shown without a cartridge.
Figure 31:
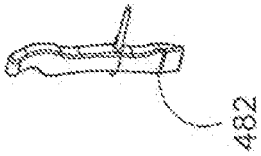
FIG. 31 is an exploded view of the launch platform of FIG. 30.
Figure 31:
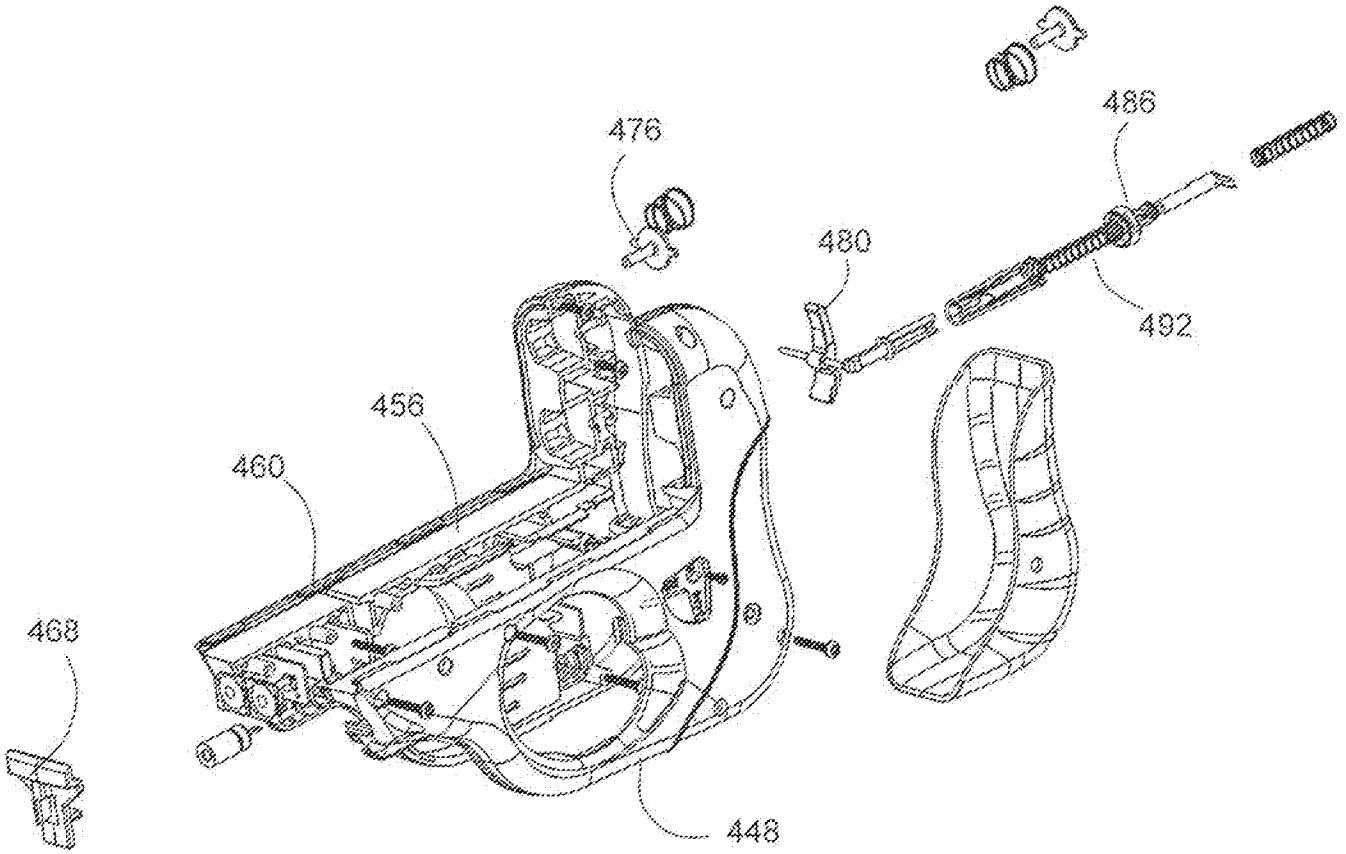
Figure 32:
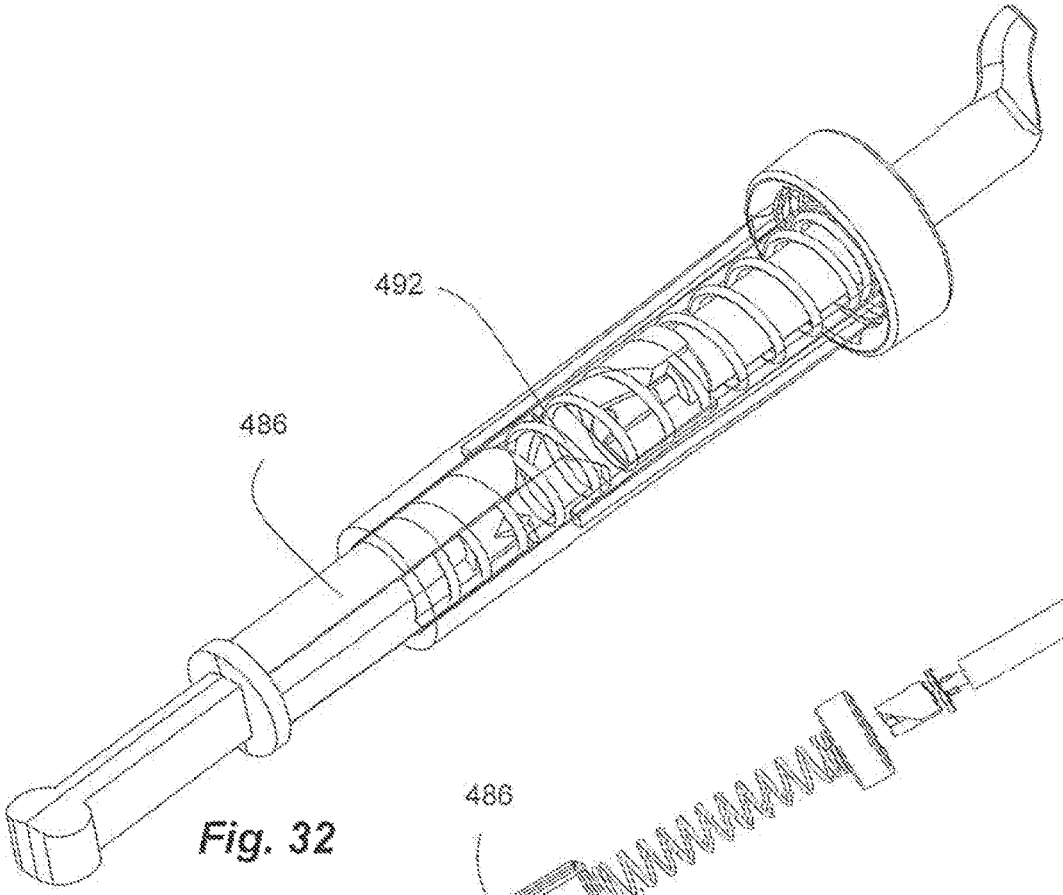
FIG. 32 is perspective view of a push rod mechanism of the launch platform of FIG. 30.
Figure 33:
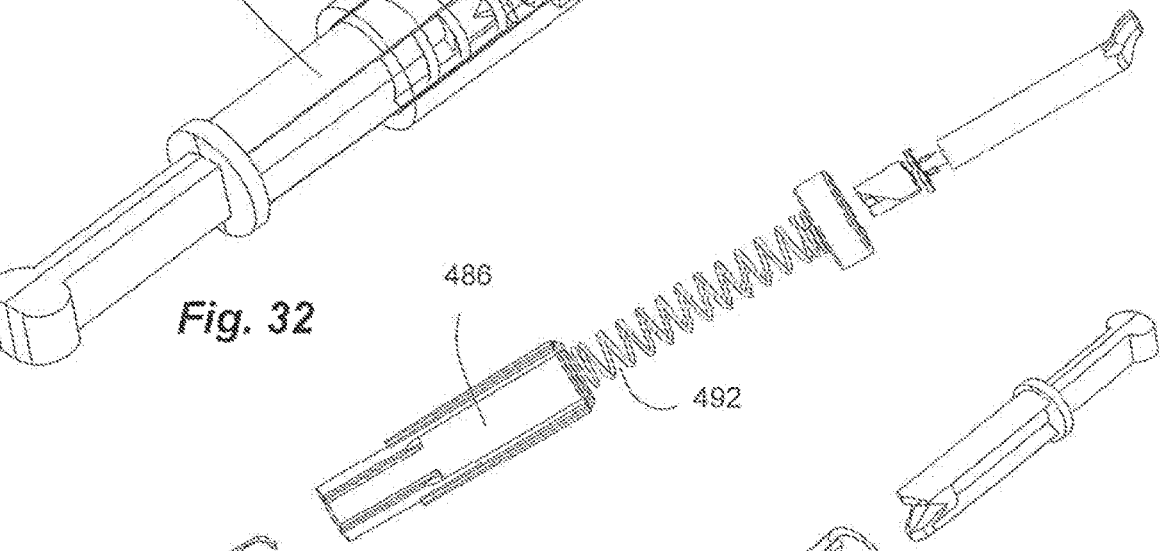
FIG. 33 is an exploded perspective view of the push rod mechanism of the launch platform of FIG. 30.
Figure 34:
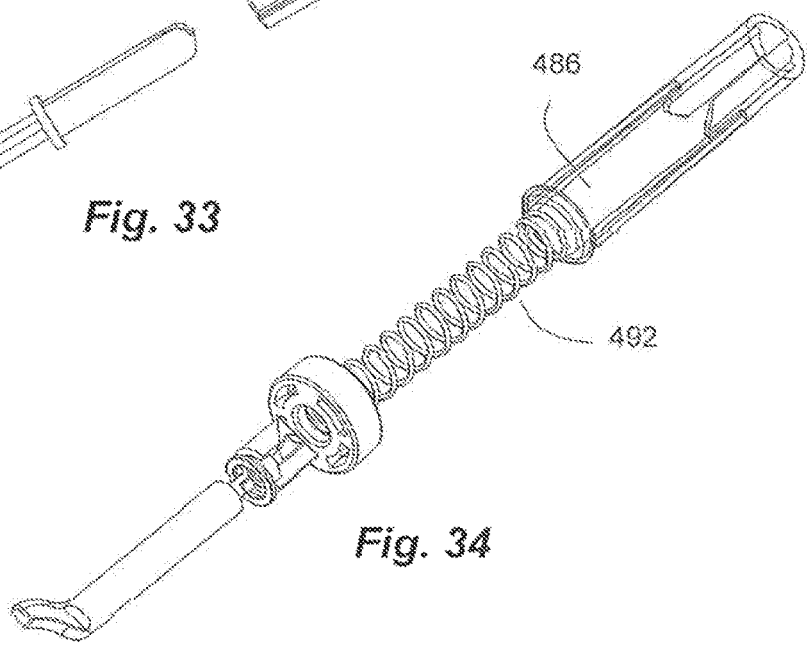
FIG. 34 is an exploded opposite perspective view of the push rod mechanism of the launch platform of FIG. 30.

Referring to FIGS. 18 and 24, balls 74 are carried by the tube 70 and selectively radially displaceable from: 1) an outer position, as shown in FIGS. 20 and 24, to 2) an inner position, as shown in FIG. 21 by the top retainer 66. In the outer position, the balls 74 are positioned radially outwardly with respect to the tube 70 to define a combined ball width greater than the open proximal end of the sleeve 54 to retain the sleeve in the retained position. The balls 74 extend between both the tube 70 and the sleeve 54. In the inner position, the balls 74 are positioned radially inward with respect to the tube 70 to define a combined ball width less than the open proximal end of the sleeve 54 to allow the sleeve to move to the released position via the spring 62.

Figure 19:
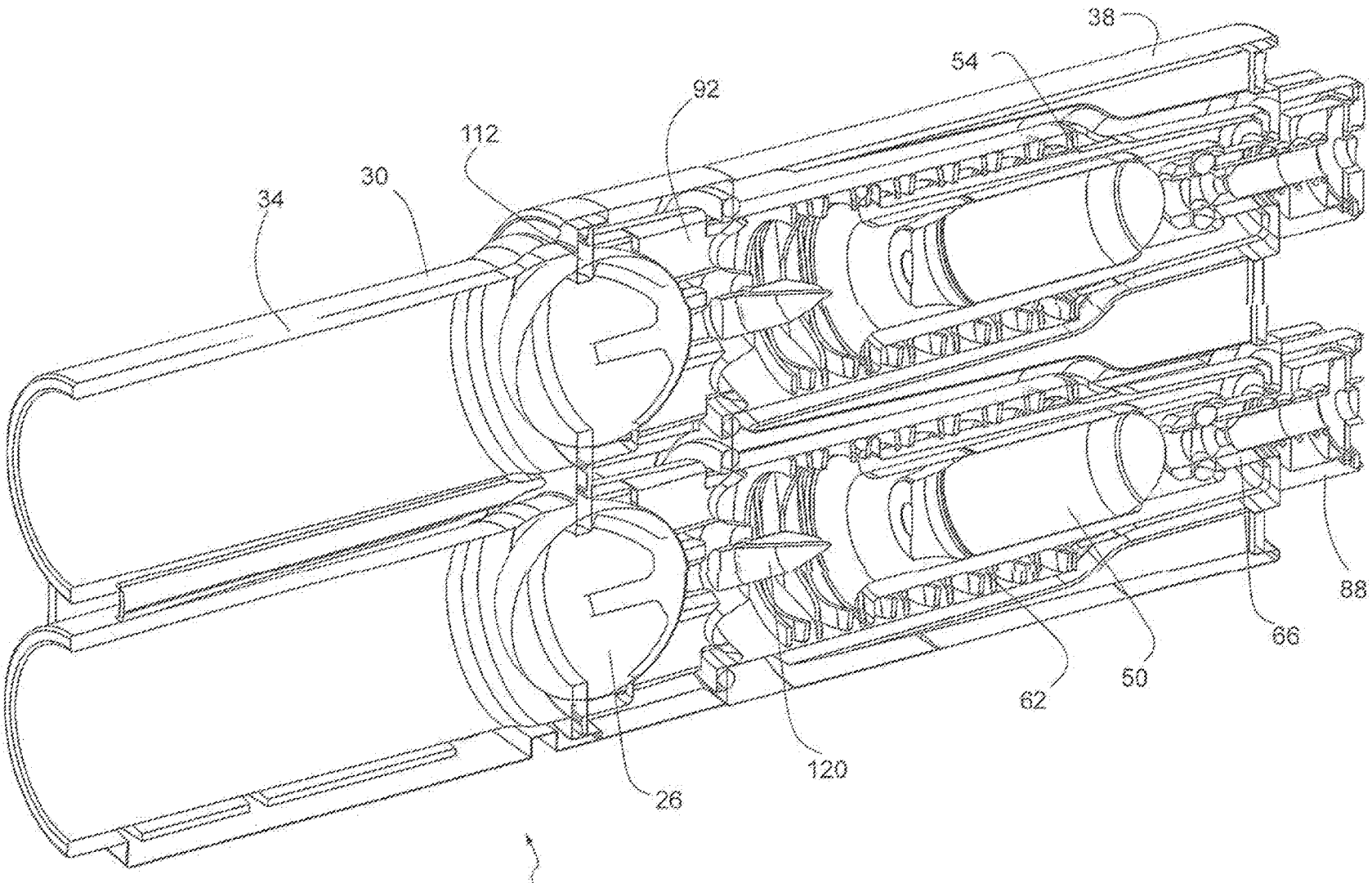
FIG. 19 is a cross-sectional side perspective view of the cartridge of FIG. 1.

A pin 78 is movably positioned in the tube 70. In addition, the pin 78 can have an enlarged portion 82 displacing the balls 74 to the outer position and a reduced portion 84 allowing the balls 74 to displace to the inner position. The pin 78 can also extend from the tube 72 to a proximal end with an enlarged head positioned in the cavity of the enlargement. The pin 78 can be biased by a spring. The tube 70, the enlargement, the balls 74, and the pin 78 can be formed of metal and can be formed by machining, casting or the like. Referring to FIGS. 18 and 19, a safety cap 88 can be carried by the housing 30 and the casing 38 and can circumscribe the proximal end and enlarged head of the pin 78 and the enlargement to resist inadvertent contact with the pin 78, and thus inadvertent release of the sleeve 54 and the vessel 50. The cap 88 can have a small aperture to receive a plunger of the launch platform 14 as described below.

Figure 22:
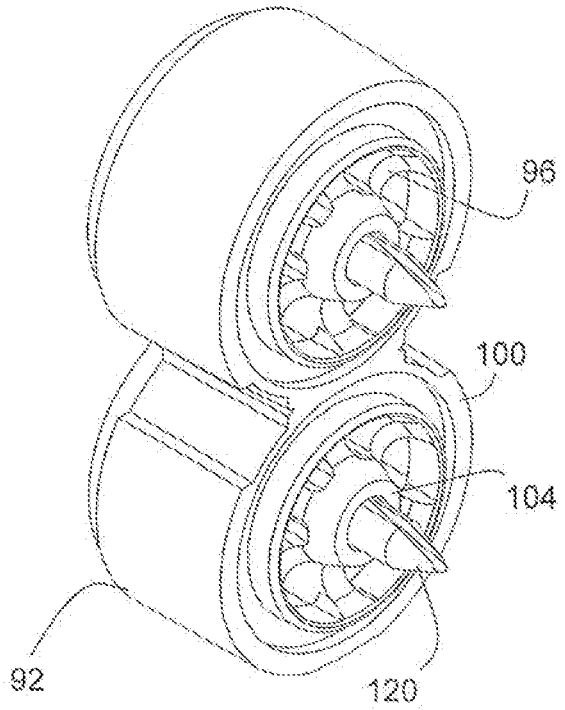
FIG. 22 is a perspective view of a diffuser of the cartridge of FIG. 1.
Figure 23:
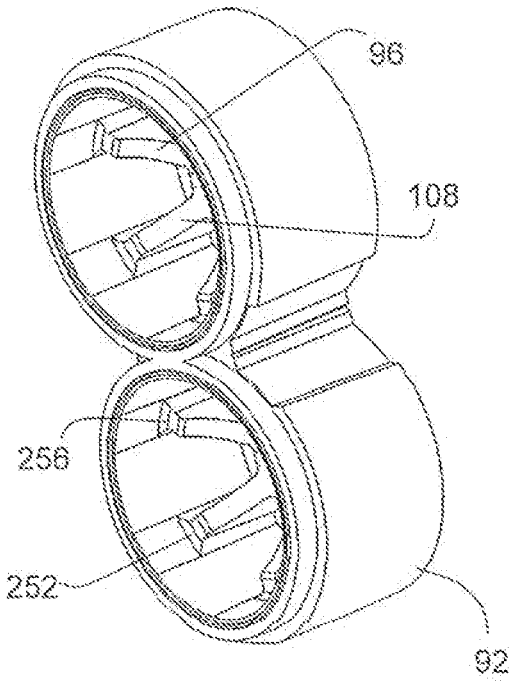
FIG. 23 is another perspective view of the diffuser of the cartridge of FIG. 1.

Referring to FIGS. 10-23, a diffuser 92 can be positioned between the compressed ball 26 and the compressed gas vessel 50 and separates the compressed gas vessel 50 from the frangible ball 26. The diffuser 92 comprises a passage therethrough to spread out gas from the compressed gas vessel 50 behind the frangible ball 26. The diffuser 92 can comprise a pair of diffusers with a pair of discrete passages, but a single diffuser body as shown in FIGS. 22-23. The diffuser 92 and diffuser body can be sandwiched between the barrel 34 and the casing 38. The connection and the pair of arms 46 can extend across the diffuser 92 on opposite sides thereof. Thus, the barrel 34, the diffuser 92 and diffuser body, and the casing 38 together forming at least a part of a housing 30. The flange 58 of the sleeve 54 can abut to the diffuser 92 in the released position to substantially seal the sleeve 54 to the diffuser 92 under the force of the spring 62.

Referring to FIGS. 22 and 23, the diffuser 92 can comprise at least one vane 96 in the passage and dividing the passage into diffuse pathways. In addition, the diffuser 92 and diffuser body can comprise an outer annulus or rim 100 and an inner hub 104. The passage extends between the outer annulus 100 and the inner hub 104. A plurality of vanes 96 can be arrayed circumferentially around the hub 104 and extending between the outer annulus 100 and the inner hub 104 to form a plurality of passages. The diffuser 92 and the passages can have a volume to accumulate gas from the compressed gas cylinder 50 behind the frangible ball 26.

The frangible ball 26 can be carried by the housing 30 and positioned in front of the compressed gas vessel 50. In addition, the frangible ball 26 can be carried by the diffuser 92. Trailing edges of the vanes 96 facing the barrel 34 can be arcuate and together can forming a semi-spherical recess and seat 108 to receive the frangible ball 26. A portion of the frangible ball 26 is seated in the recess 108 and abutting to the trailing edge of the vanes 96.

Referring to FIGS. 18-21, an annular seal 112 is carried by the housing and circumscribes the frangible ball 26. The annular seal 112 is positioned at an opening of the recess 108 and forward of a widest portion or diameter of the frangible ball 26. The annular seal 112 extends between the frangible ball 26 and the housing 30. The seal 112 has an undersized hole 116 (FIG. 18) smaller than the widest portion or diameter of the frangible ball 26. The seal 112 and the undersized hole 116 selectively retain the frangible ball 26 in the recess 108 and the housing 30 until pressure from the compressed gas builds behind the frangible ball 26 sufficient to force the frangible ball 26 through the undersized hole 116 in the seal 112. The annular seal 112 can have an outer flange or perimeter retained between the diffuser 92 and the barrel 34. Thus, the outer flange can also act as a seal between the diffuser 92 and the barrel 34.

A cannula 120 is carried by the housing 30 and the diffuser 92. The cannula 120 can be carried by the inner hub 104 of the diffuser 92 with the vanes 96 of the diffuser 92 radiating therefrom, as shown in FIG. 22. The frangible ball 26 in the recess 108 of the diffuser 92 is positioned opposite the cannula 120. The cannula 120 has a sharp tip positioned to pierce the compressed gas vessel 50 in the released position to release the compressed gas therefrom. The cannula 120 can be fluted with at least one flute in the outer surface to facilitate the escape of gas from the vessel 50 and dispersion of the gas to the diffuser 92.

The seal 112 (and the frangible ball 26), the sleeve 54 and the diffuser 92 can together define a chamber 124 (FIG. 20) to accumulate the compressed gas when released from the compressed gas vessel 50. As described above, the sleeve 54 substantially seals against the diffuser 92, and the annular seal 112 seals against the frangible ball 26. The chamber 124 can have a volume and/or the annular seal 112 can have a material and dimensions to project the frangible ball with sufficient speed. In one aspect, the chamber 124 and/or the annular seal 112 can impart substantially 15 Joules to the frangible ball 26 and substantially 61 meters per second velocity to the frangible ball 26.

The frangible ball 26 can have a shell containing the irritant. The shell can be formed of wax, and the irritant can be, or can be carried by, a powder in the shell. The frangible ball 26 can have a weight of substantially 3 grams, and a diameter of substantially 17 mm.

As described above, the cartridge 22 can be a double shot cartridge. The double shot cartridge can comprise: a pair of aligned barrels 34; a pair of separate and distinct projectiles 26 associated with the pair of barrels 34, respectively: a pair of compressible gas vessels 50 associated with the pair of barrels 34, respectively; a pair of sleeves 54 containing the pair of vessels 50, respectively; a pair of diffusers 92 with passages associated with the pair of barrels 34, respectively, and sharing a single, integrated body; and a pair of cannulas 120 associated with the pair of compressible gas vessels 50, respectively.

The pair of aligned barrels 34 can comprise an upper barrel and a lower barrel. The dovetail attachment 42 can extend from the lower barrel. Similarly, the dovetail attachment 42 can extend from the casing 38. The upper barrel 34 and the upper casing 38 can have a smooth surface opposite the dovetail attachment 34 of the lower barrel. Thus, the system 10 can be more easily retrieved from storage.

Referring to FIGS. 25-29, another cartridge 222 is shown carrying a gel or powder 26 containing irritant, defining a gel cartridge or powder cartridge. The gel or powder cartridge 222 is similar in many respects to the ball cartridge 22 described above, and which description is hereby incorporated herein by reference. As described above, the cartridges 22 and 222 can be formed by a cartridge precursor that has many common parts which can be configured with additional parts to form the ball cartridge 26 or the gel or powder cartridge 222.

The cartridge 222 comprises a cylindrical container 226 that contains the irritant in a gel or powder form. The container 226 can be displaced and ruptured under force of the compressed gas to eject the gel or powder from the barrel 34. Unlike the frangible gall 26 of the ball cartridge 22 that is propelled from the barrel 34, the container 226 of the gel or powder cartridge 222 remains in the barrel 34, and the gel or powder is expelled from the barrel 34. Thus, the ball cartridge 22 shoots the frangible ball 26 which breaks upon impact to release the powder; whereas the gel or powder of the container 226 is squirted and sprayed from the barrel 34 of the gel or powder cartridge 222.

The cartridge 222 and the container 226 comprise a barrel liner 228 movably positioned inside the barrel 34 and containing the gel or the powder. The barrel liner 228 can be a cylindrical tube with opposite proximal and distal ends. A plunger 232 is movably positioned at the proximal end of the barrel liner 228. The plunger 232 can have a perimeter wiper seal that contacts an interior of the barrel liner 228 to maintain a seal between the plunger 232 and the barrel liner 228. A burst membrane 236 closes the distal end of the barrel liner 228. Together, the barrel liner 228, the plunger 232 and the bust membrane 236 form the container 226 containing the gel or the powder.

The cartridge 222 also comprises a forward cannula 240 disposed at a distal end of the barrel 34. The forward cannula 240 has a sharp tip to rupture the burst membrane 236 of the container 226 and place the forward cannula in communication or contact with the gel or the powder. A nozzle 244 is opposite the forward cannula 240. The forward cannula 240 and the nozzle 244 can have hollows therethrough that are concentric with one another and forming a flow channel to convey the gel or the powder out of the barrel 34. The forward cannula 240 and the nozzle 244 can be integrally formed as a single body that can form a cap or plug 248 that can span an open end of the barrel 34. The plug 248 can be sealed to the barrel 34. The container 226 and the barrel liner 228 are displaceable towards the distal end of the barrel 34 with the burst membrane 236 being displaceable towards the forward cannula 240 under the force of the compressed gas.

Referring again to FIGS. 22 and 23, the trailing edges of the vanes 96 of the diffuser 92 can each having a step 252 that together form an annular landing 256 to receiving a proximal end of the barrel liner 228 and the container 226. Thus, the diffuser 92 accommodates and provides an interface for both the frangible ball 26 and the container 226.

Referring again to FIGS. 25-29, an annular seal 260 is carried by the housing 30 and the cartridge 222, and extends between the barrel liner 228 of the container 226 and the housing 30 and the barrel 34. The annular seal 260 can have a perimeter flange between the barrel 34 and the diffuser 92. In addition, the annular seal 260 can have an inner cylindrical portion circumscribing and abutting to the barrel liner 228 of the container 226. The annular seal 260 can provide an interference fit with the barrel liner 228 to retain the barrel liner 228 and the contain 226 against the steps 252 and the landing 256 of the diffuser 92, and away from the forward cannula 240. Like the annular seal 112 of the ball cartridge 22, the annular seal 260 of the gel or powder cartridge 222 is carried by the housing 30, circumscribes the projectile (namely the gel or powder in the container 226), and extends between the projectile (namely the gel or powder in the container 226) and the housing 30 to retain the projectile (namely the gel or powder in the container 226) in the housing 30 until the compressed gas is released from the compressed gas vessel 50. The annular seal 260 and the diffused 92 allow pressure from the compressed gas to build behind the container 226 sufficient to force the container 226 forward in the barrel 34, the forward cannula 240 through the burst membrane 236, and the plunger 232 though the barrel liner 228 to expel the gel or powder through the nozzle 244.

The launch platform 14 and the cartridges 18 can be provided in a non-lethal self-protection kit. The kit can comprise at least two cartridges 18. For example, the kit can comprise two cartridges, namely a ball cartridge 22 and a gel or powder cartridge 222. As another example, the kit can comprise three cartridges, namely a ball cartridge 22, a gel cartridge 222, and a powder cartridge 222. Another practice cartridge can also be provided in the kit. The practice cartridge can comprise a frangible ball, just as the ball cartridge 22, gel or powder but without irritant therein. The frangible ball of the practice cartridge can contain an inert powder. Thus, the practice cartridge can be used to become familiarized with the system 10. As described above, the launch platform 14 interchangeably receives the cartridges 18. In one aspect, the cartridge 18 can have different colors and can thus be color coded. One color can be on the ball cartridge that is indicative of the frangible ball; another different color can be on the gel cartridge that is indicative of the gel; another different color can be on the powder cartridge that is indicative of the powder; and another different color can be on the practice cartridge that is indicative of the frangible ball without irritant. In one aspect, the barrels of the different cartridges can have the different colors.

As discussed above, the components common to both the ball cartridge 22 and the gel or powder cartridge 222 can define a cartridge precursor. Thus the cartridge precursors can be produced in bulk, and outfitted with a particular projectile. The cartridge precursor can also carry the interface, such as the dovetail attachment 42, so that the cartridges 18 are interchangeable with the launch system 14.

As described above, the cartridges 18 can be utilized, and interchanged, with the launch platform 14. The launch platform 14 can removably and interchangeably receive the cartridges 18, and the dovetail attachments 42 thereof. In addition, the launch platform 14 can provide a way to handle and use the cartridges 18.

Referring to FIGS. 30-34, the launch platform 14 can have a handle 448 with a grip 452. In one aspect, the cartridge 18 can also form part of the handle 448 along with the launch platform 14. Thus, the system 10 can be gripped with the two middle fingers around the grip 452 and the first finger extending forward along the cartridge 18 pointing in the direction of aim.

The launch platform 14 has a slide attachment 456 matching the dovetail attachment 42 of the cartridge 18. The slide attachment 456 can have a dovetail joint 460 between the cartridge 18 and the handle 448. In addition, the slide attachment 456 can have a pocket 464 in the handle 448 behind the dovetail joint 460 to receive a portion of the cartridge 18, namely the safety cap 88 and a portion of the retainer 66. A slide lock 468 can be carried by the handle 448 to engage the cartridge 18 to selectively retain the cartridge 18 on the slide attachment 456.

A trigger 472 is carried by the handle 448 and movable with respect to the grip 452. In addition, a plunger 476 is carried by the handle 448 and is displaceable by the trigger 472 to engage the cartridge 18, and the retainer 66, to allow the compressed gas vessel 50 to move to the released position. Namely, the plunger 476 can be pressed through the hole in the safety cap 88 and against the enlarged head of the pin 78 of the retainer 66.

As described above, the cartridges 18 can be dual barreled cartridges with dual projectiles. Thus, the launch platform 14 can have a pair of plungers 476 corresponding to the pair of retainers 66 and the pair of compressed gas vessels 50 of the cartridges 18. In addition, the trigger 472 can selectively and alternately activate the plungers 476, and thus the projectiles. A pair of lever arms, such as a short arm 480 and a long arm 482, can be carried by the handle 448. The arms 480 and 482 can be selectively and alternately engaged by the trigger, and can extend to a respective plunger 476. The arms 480 and 482 can pivot when a lower end is engaged by the trigger 472, causing an upper end to push against and displace the plunder 476. In one aspect, the arms 480 and 482 can be positioned laterally side-by-side. A push rod mechanism 486 can extend from trigger 472 to the arms 480 and 482. The push rod mechanism 486 has opposite rod ends separated by a rotational clutch 492. A trigger end of the push rod mechanism 486 is pushed by the trigger, while the opposite arm end engages the arms 480 and 482. The arm end can have an offset finger to engage one of the arms 480 or 482. As the trigger 472 pushes against the trigger end of the push rod mechanism 486, the offset finger of the arm end of the push rod mechanism 486 pushes against one of the arms 480 or 482. The rotational clutch rotates the arm end of the push rod mechanism 486 with respect to the trigger end. Thus, on a subsequent pull of the trigger 472, the offset finger of the arm end of the push rod mechanism 486 pushes against the other one of the arms 480 or 482.

The launch platform 14 and the handle 448 can further carry other self-defense items. In one aspect, at least one LED light can face forwardly to blind an assailant. In another aspect, two LED lights can be provided with different lenses, such as a narrow focus lens, and a wider focus lens. In another aspect, a laser can face forwardly to assist in aiming and deterring an assailant. The lights and laser can be powered by a rechargeable battery carried in the handle 448. The launch platform 14 can have a safety that engages circuitry in the handle 448 to turn on the lights and the laser.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A cartridge configured for a non-lethal self-protection system and to be removably received by a launch platform, the cartridge comprising:

a) a housing having a barrel;

b) a compressed gas vessel carried by the housing and containing a compressed gas;

c) a projectile carried by the housing and positioned in front of the compressed gas vessel, the projectile containing an irritant; and d) a cannula carried by the housing and having a sharp tip positioned to pierce the compressed gas vessel to release the compressed gas to eject the projectile with the irritant.

2. The cartridge in accordance with claim 1, further comprising:

the compressed gas vessel having two positions comprising: i) a retained position farther from the barrel, and ii) a released position closer to the barrel;

a spring carried by the housing to bias the compressed gas vessel towards the released position; and the cannula positioned to pierce the compressed gas vessel in the released position to release the compressed gas.

3. The cartridge in accordance with claim 2, further comprising:

a sleeve movably carried by the housing and containing the compressed gas cylinder and having a forward opening, the sleeve movable with the compressed gas cylinder between the retained and released positions.

4. The cartridge in accordance with claim 2, further comprising:

a retainer carried by the housing and selectively retaining the compressed gas vessel in the retained position.

5. The cartridge in accordance with claim 1, further comprising:

a diffuser positioned between the projectile and the compressed gas vessel, the diffuser comprising a passage therethrough configured to spread out gas from the compressed gas vessel behind the projectile.

6. The cartridge in accordance with claim 5, further comprising:

the diffuser comprising at least one vane in the passage and dividing the passage into diffuse pathways.

7. The cartridge in accordance with claim 5, wherein the diffuser further comprises:

a) an outer annulus;

b) inner hub carrying the cannula; and c) a plurality of vanes arrayed circumferentially around the hub and extending between the outer annulus and the inner hub.

8. The cartridge in accordance with claim 5, further comprising:

a) the diffuser separating the compressed gas vessel from the projectile; and b) the diffuser having a volume configured to accumulate gas from the compressed gas cylinder.

9. The cartridge in accordance with claim 5, further comprising:

a) a casing coupled to the barrel;

b) the diffuser being sandwiched between the barrel and the casing; and c) the barrel, the diffuser and the casing together forming at least a part of a housing.

10. The cartridge in accordance with claim 5, wherein the diffuser further comprises:

a) a plurality of vanes radiating from the cannula; and b) trailing edges of the plurality of vanes being arcuate and together forming a semi-spherical recess receiving the projectile.

11. The cartridge in accordance with claim 1, further comprising:

an annular seal carried by the housing and circumscribing the projectile and extending between the projectile and the housing to retain the projectile in the housing until the compressed gas is released from the compressed gas vessel.

12. The cartridge in accordance with claim 1, further comprising:

a) the projectile comprising a frangible ball;

b) an annular seal carried by the housing and circumscribing the frangible ball and extending between the frangible ball and the housing to retain the frangible ball in the housing until the compressed gas is released from the compressed gas vessel; and c) the seal having an undersized hole smaller than the frangible ball to selectively retain the frangible ball until pressure from the compressed gas builds behind the frangible ball.

13. The cartridge in accordance with claim 1, wherein the projectile is a gel or a powder, and further comprising:

a) a barrel liner movably positioned inside the barrel and containing the gel or the powder;

b) a plunger movably positioned at a proximal end of the barrel liner;

c) a burst membrane closing a distal end of the barrel liner;

d) a forward cannula disposed at a distal end of the barrel;

e) a nozzle opposite the forward cannula; and f) the barrel liner being displaceable towards the distal end of the barrel with the burst membrane being displaceable towards the forward cannula.

14. The cartridge in accordance with claim 1, further comprising:

a chamber between the projectile and the compressed gas vessel to accumulate the compressed gas when released from the compressed gas vessel.

15. The cartridge in accordance with claim 1, wherein the cartridge is a double shot cartridge, and further comprising:

a) the barrel being a pair of aligned barrels;

b) the projectile comprising a pair of separate and distinct projectiles associated with the pair of barrels, respectively;

c) the compressible gas vessel comprising a pair of compressible gas vessels associated with the pair of barrels, respectively; and d) the cannula comprising a pair of cannulas associated with the pair of compressible gas vessels, respectively.

16. The cartridge in accordance with claim 1 in combination with a launch platform, the launch platform comprising:

a) a handle with a grip;

b) an attachment between the cartridge and the handle and comprising a pocket in the handle receiving a portion of the cartridge; and c) a trigger carried by the handle and movable with respect to the grip.

17. A non-lethal self-protection kit comprising at least two cartridges in accordance with claim 1, the kit further comprising:

the at least two cartridges comprising one cartridge comprising a frangible ball as the projectile and another cartridge comprising a gel as the projectile; and a launch platform interchangeably receiving the at least two cartridges.

18. A cartridge configured for a non-lethal self-protection system, the cartridge comprising:

a) a housing having a double barrel comprising a pair of aligned barrels;

b) a pair of compressed gas vessels carried by the housing and associated with the pair of barrels, respectively, each compressed gas vessel containing a compressed gas;

c) a pair of projectiles associated with the pair of barrels, respectively, each projectile containing an irritant;

d) a pair of diffusers positioned between the pair of projectiles and the pair of compressed gas vessels, respectively, the pair of diffusers each comprising a passage therethrough configured to spread out gas from a respective compressed gas vessel behind a respective projectile; and e) a pair of cannulas carried by the pair of diffusers, respectively, and associated with the pair of compressed gas vessels, respectively, each cannula having a sharp tip positioned to pierce a respective compressed gas vessel.

19. A non-lethal self-defense system comprising a cartridge in combination with a launch platform, the system comprising:

a handle with a grip;

a trigger carried by the handle and movable with respect to the grip;

a housing having a barrel;

a compressed gas vessel containing a compressed gas;

the compressed gas vessel having two positions comprising: i) a retained position farther from the barrel, and ii) a released position closer to the barrel;

a spring to bias the compressed gas vessel towards the released position;

a projectile carried by the housing and positioned in front of the compressed gas vessel, the projectile containing an irritant;

a cannula carried by the housing and having a sharp tip positioned to pierce the compressed gas vessel to release the compressed gas in the released position to release the compressed gas.

20. The system in accordance with claim 19, further comprising:

a diffuser positioned between the projectile and the compressed gas vessel, the diffuser comprising a passage therethrough configured to spread out gas from the compressed gas vessel behind the projectile.

* * * * *